US011132902B2

(12) United States Patent
Rosen et al.

(10) Patent No.: US 11,132,902 B2
(45) **Date of Patent: *Sep. 28, 2021**

(54) PARKING SPACE LIGHT

(71) Applicant: Resilience Magnum IP, LLC, Cleveland, OH (US)

(72) Inventors: Steven Rosen, Hunting Valley, OH (US); Ronald Cozean, Madison, CT (US); Eric Allen, Long Beach, CA (US); David Edward Mordetzky, Oak Park, CA (US); Megan Horvath, Cleveland, OH (US); Anthony John Pyros, Cleveland, OH (US); John Elwood, Santa Ana, CA (US); Michael Chang, Long Beach, CA (US); Elie Attarian, Chatsworth, CA (US)

(73) Assignee: RESILIENCE MAGNUM IP, LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/682,085

(22) Filed: Nov. 13, 2019

(65) Prior Publication Data

US 2020/0082720 A1 Mar. 12, 2020

Related U.S. Application Data

(63) Continuation of application No. 16/043,974, filed on Jul. 24, 2018, now Pat. No. 10,510,251.

(Continued)

(51) Int. Cl.
*G08G 1/14* (2006.01)

(52) U.S. Cl.
CPC ..... *G08G 1/149* (2013.01); *G08G 1/142* (2013.01); *G08G 1/146* (2013.01); *G08G 1/148* (2013.01)

(58) Field of Classification Search
CPC ..... G08G 1/14; G08G 1/141; G08G 1/142; G08G 1/144; G08G 1/146; G08G 1/148;

(Continued)

(56) References Cited

U.S. PATENT DOCUMENTS 6,147,624 A 11/2000 Clapper
6,236,303 B1 5/2001 Wagner et al.

(Continued)

FOREIGN PATENT DOCUMENTS

CN 105371177 A 3/2016
CN 105959380 A 9/2016

OTHER PUBLICATIONS

Non-Final Office Action received for U.S. Appl. No. 16/044,047 dated Dec. 26, 2018, 22 pages.

(Continued)

*Primary Examiner* — Eric Blount
(74) *Attorney, Agent, or Firm* — Amin, Turocy & Watson, LLP

(57) ABSTRACT

Techniques for parking space light are provided. A parking space light can identify, via one or more instruments of the parking space light, a set of parking spaces in a defined region of a parking structure in which the parking space light is installed, monitor, via the one or more instruments, the set of parking spaces, and determine respective occupied statuses of parking spaces of the set of parking spaces, wherein the respective occupied statuses indicate whether the parking spaces are occupied or unoccupied.

19 Claims, 17 Drawing Sheets

Related U.S. Application Data

(60) Provisional application No. 62/568,294, filed on Oct. 4, 2017, provisional application No. 62/581,914, filed on Nov. 6, 2017.

(58) Field of Classification Search
CPC ..... G08G 1/149; G06K 9/00624; G06K 9/00; G07B 15/02
USPC ..... 340/932.2, 531, 937; 348/148, 149; 382/104; 705/13
See application file for complete search history.

(56) References Cited

U.S. PATENT DOCUMENTS 6,946,974 B1 * 9/2005 Racunas, Jr. ..... G06Q 10/02 235/378
7,026,954 B2 * 4/2006 Slemmer ..... G08G 1/14 340/932.2
7,111,952 B2 9/2006 Veskovic
7,824,065 B2 11/2010 Maxik
8,280,558 B2 10/2012 Picco
8,283,812 B2 10/2012 Azancot et al.
8,362,713 B2 1/2013 Recker et al.
8,600,786 B2 12/2013 Stefik et al.
8,674,616 B2 3/2014 Holman et al.
8,950,461 B2 2/2015 Adams et al.
9,367,050 B2 * 6/2016 Jain ..... G08B 21/18
9,560,388 B2 1/2017 Ogle et al.
9,594,956 B2 3/2017 Cohen et al.
9,595,193 B1 3/2017 Duale et al.
9,601,018 B2 * 3/2017 Cogill ..... G08G 1/143
9,644,799 B2 5/2017 Crayford et al.
9,700,641 B2 7/2017 Hawkins et al.
9,893,551 B2 2/2018 Cheatham, III et al.
9,938,765 B2 4/2018 Berman et al.
10,210,355 B1 2/2019 Lai
10,251,242 B1 4/2019 Rosen et al.
10,677,402 B2 6/2020 Rosen et al.
2002/0171562 A1 11/2002 Muraki
2004/0022058 A1 2/2004 Birrell
2005/0128751 A1 6/2005 Roberge et al.
2005/0248299 A1 11/2005 Chemel et al.
2006/0197684 A1 9/2006 Tremblay
2008/0191009 A1 8/2008 Gressel et al.
2009/0059603 A1 5/2009 Recker et al.
2009/0303079 A1 * 12/2009 Khim ..... G08G 1/146 340/932.2
2010/0007525 A1 1/2010 Shanbhag et al.
2010/0060485 A1 3/2010 Kim
2010/0309024 A1 12/2010 Mimeault
2011/0006893 A1 1/2011 Finch et al.
2011/0193872 A1 8/2011 Biemath et al.
2012/0011033 A1 1/2012 Salgia
2012/0066144 A1 3/2012 Berkvens et al.
2012/0092192 A1 * 4/2012 Wong ..... H05B 47/19 340/932.2
2012/0098655 A1 4/2012 Preta et al.
2013/0002587 A1 1/2013 Biggs et al.
2013/0073350 A1 3/2013 Blustein
2013/0113936 A1 * 5/2013 Cohen ..... G08G 1/14 348/148
2013/0300911 A1 11/2013 Beckman
2014/0055990 A1 2/2014 Reed
2014/0262057 A1 9/2014 Chambers et al.
2015/0195100 A1 7/2015 Imes et al.
2015/0286938 A1 10/2015 Blair et al.
2016/0047164 A1 2/2016 Lundy et al.
2016/0085884 A1 3/2016 Schafer et al.
2016/0135271 A1 3/2016 Alexander
2016/0104325 A1 * 4/2016 Lu ..... G07B 15/02 705/13
2016/0216443 A1 7/2016 Morgan et al.
2016/0359325 A1 12/2016 Kawata et al.
2017/0073074 A1 3/2017 Gagnon et al.
2017/0094756 A1 3/2017 Saffari
2017/0192406 A1 7/2017 Ashdown et al.
2017/0247289 A1 8/2017 Waldschmidt et al.
2017/0322350 A1 11/2017 Montagne
2018/0096634 A1 4/2018 Walker et al.
2018/0156429 A1 6/2018 Carlet et al.
2018/0211503 A1 7/2018 Baliga et al.
2018/0216791 A1 8/2018 Leung et al.
2018/0224596 A1 8/2018 Creasman et al.
2018/0259141 A1 9/2018 Yamaguchi et al.
2018/0313660 A1 11/2018 Eyster et al.
2019/0069379 A1 2/2019 Kastee et al.
2019/0104181 A1 4/2019 Rosen et al.

OTHER PUBLICATIONS

Notice of Allowance received for U.S. Appl. No. 16/044,073 dated Nov. 8, 2018, 20 pages.
Non-Final Office Action received for U.S. Appl. No. 16/043,974 dated May 2, 2019, 28 pages.
Non-Final Office Action received for U.S. Appl. No. 16/043,798 dated Jun. 27, 2019, 15 pages.
Non-Final Office Action received for U.S. Appl. No. 16/130,720 dated Jul. 25, 2019, 37 pages.
Non-Final Office Action received for U.S. Appl. No. 16/270,646 dated Aug. 21, 2019, 29 pages.
Non-Final Office Action received for U.S. Appl. No. 16/739,627 dated Feb. 7, 2020, 19 pages.
Non-Final Office Action received for U.S. Appl. No. 16/544,023 dated Apr. 9, 2020, 28 pages.
Non-Final Office Action received for U.S. Appl. No. 16/043,997 dated Apr. 8, 2020, 46 pages.
Non-Final Office Action received for U.S. Appl. No. 16/821,007 dated May 1, 2020, 36 pages.
Non-Final Office Action received for U.S. Appl. No. 16/044,027 dated Jun. 22, 2020, 48 pages.
Notice of Allowance received for U.S. Appl. No. 16/043,949 dated May 21, 2020, 49 pages.
Non-Final Office Action received for U.S. Appl. No. 16/043,875 dated May 27, 2020, 15 pages.
Notice of Allowance received for U.S. Appl. No. 16/043,997 dated Aug. 7, 2020, 46 pages.
Non-Final Office Action received for U.S. Appl. No. 16/856,434 dated Sep. 1, 2020, 50 pages.
Final Office Action received for U.S. Appl. No. 16/044,027 dated Oct. 8, 2020, 29 pages.
Final Office Action received for U.S. Appl. No. 16/043,875 dated Jan. 25, 2020, 13 pages.
Non-Final Office Action received for U.S. Appl. No. 16/739,627 dated Apr. 26, 2021, 31 pages.
Non-Final Office Action received for U.S. Appl. No. 16/043,875 dated May 26, 2021, 45 pages.
Non-Final Office Action received for U.S. Appl. No. 16/044,027 dated Jun. 9, 2021, 29 pages.
Non-Final Office Action received for U.S. Appl. No. 17/062,929 dated May 5, 2021, 38 pages.
Non-Final Office Action received for U.S. Appl. No. 17/099,928 dated Jun. 24, 2021, 53 pages.
Notice of Allowance received for U.S. Appl. No. 17/005,534 dated Aug. 4, 2021, 50 pages.
Notice of Allowance received for U.S. Appl. No. 17/062,929 dated Aug. 9, 2021, 27 pages.

* cited by examiner

PARKING SPACE LIGHT

CROSS-REFERENCE TO RELATED APPLICATIONS

This application is a continuation of, and claims priority to each of, U.S. patent application Ser. No. 16/043,974, filed on Jul. 24, 2018, entitled "PARKING SPACE LIGHT", and now issued as U.S. Pat. No. 10,510,251, which claims the benefit of U.S. Provisional Patent Application Ser. No. 62/581,914 filed on Nov. 6, 2017, entitled "PARKING SPACE LIGHT" and U.S. Provisional Patent Application Ser. No. 62/568,294 filed on Oct. 4, 2017, entitled "SELF AWARE LIGHTS THAT SELF-CONFIGURE." The entireties of the aforementioned applications are incorporated by reference herein.

BACKGROUND

The subject disclosure relates generally to parking structure lights.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, systems, computer-implemented methods, apparatus and/or computer program products that facilitate operation of a parking space light are described.

According to an embodiment, a parking space light bulb is provided. The parking space light bulb comprises one or more instruments, a memory that stores computer executable components, and a processor that executes the computer executable components stored in the memory. The computer executable components can comprise: a mapping component that employs at least one instrument of the one or more instruments to identify a set of parking spaces in a defined region of a parking structure in which the parking space light bulb is installed; and a parking space monitoring component that monitors the set of parking spaces and determines respective occupied statuses of parking spaces of the set of parking spaces, wherein the respective occupied statuses indicate whether the parking spaces are occupied or unoccupied.

In another embodiment, a parking space light is provided. The parking space light comprises a parking space light fixture, a parking space light bulb configured for installation in the parking space light fixture, one or more instruments located in at least one of the parking space light bulb or the parking space light fixture, a memory that stores computer executable components, and a processor that executes the computer executable components stored in the memory. The computer executable components can comprise: a mapping component that employs at least one instrument of the one or more instruments to identify a set of parking spaces in a defined region of a parking structure in which the parking space light is installed; and a parking space monitoring component that monitors the set of parking spaces and determines respective occupied statuses of parking spaces of the set of parking spaces, wherein the respective occupied statuses indicate whether the parking spaces are occupied or unoccupied.

In another embodiment, a method comprises: identifying, by a parking space light bulb via one or more instruments of the parking space light bulb, a set of parking spaces in a defined region of a parking structure in which the parking space light bulb is installed; monitoring, by the parking space light bulb via the one or more instruments, the set of parking spaces; and determining, by the parking space light bulb, respective occupied statuses of parking spaces of the set of parking spaces, wherein the respective occupied statuses indicate whether the parking spaces are occupied or unoccupied.

DETAILED DESCRIPTION

Figure 1:
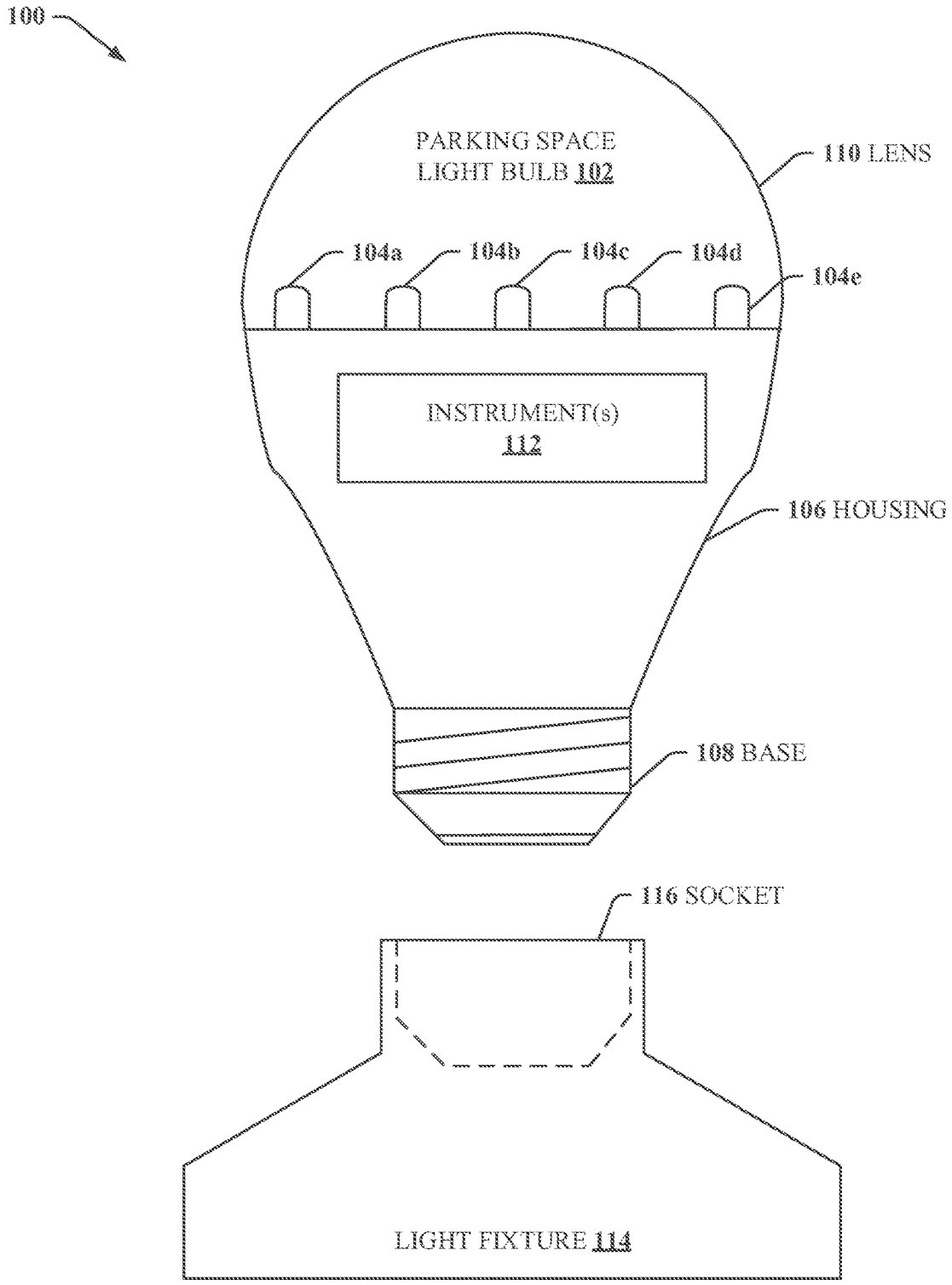
FIG. 1 illustrates a block diagram of an example, non-limiting parking space light in accordance with one or more embodiments described herein.

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident; however in various cases, that the one or more embodiments can be practiced without these specific details.

Many parking structures do not have systems that provide indications of quantity of unoccupied parking spaces and where those unoccupied parking spaces are located due to the significant costs of installing said systems. Therefore, these systems are generally installed in newly constructed parking structures where the costs can be rolled into the overall project cost. These systems require installation of conduit and wiring throughout the parking garage to connect sensors and indicators lights in each parking space to a central system that determines unoccupied/occupied parking spaces and provides a display, which is also connected through conduit and wiring, at a garage entrance indicating number of open spots available.

There is a need for a cost-effective mechanism to add the capability of providing indications of quantity of unoccupied parking spaces and where those unoccupied parking spaces are located in an existing parking structure.

In accordance with various disclosed aspects, a parking space light that comprises instruments, and is able to communicate with other parking space lights and other devices is presented. Most parking structures have conventional lighting fixtures distributed throughout the parking structure to provide conventional lighting. Parking space light can take advantage of the existing lighting system, and be installed as a retrofit to replace light bulb and/or light fixtures of the existing lighting system to add the capability of providing indications of quantity of unoccupied parking spaces and where those unoccupied parking spaces are located in an existing parking structure.

The parking space light can have artificial intelligence capabilities and can employ sensors to monitor parking spaces within a defined area around the parking space light. This is advantageous because if there is not currently a light for each parking space, one parking space light can function for multiple parking spaces. The parking space light can determine whether parking spaces are unoccupied or occupied within the defined area (e.g., determine occupied status). The parking space light can project a first color/pattern of light to indicate that there is at least one unoccupied parking space in its defined area. The parking space light can project a second color/pattern of light to indicate that there are no unoccupied parking spaces in its defined area. The parking space light can wirelessly communicate the occupied statuses of parking spaces in its defined area to display devices as entrances at the parking structure that can display a count of unoccupied parking spaces in the parking structure based on information received from a plurality of parking space lights.

A set of parking space lights can operate in a coordinated manner to determine whether parking spaces are unoccupied/occupied within their defined areas. Two parking space lights can have overlapping defined areas to provide better visibility to parking spaces near the outer limits of their defined areas, and communicate with each other to make determinations regarding occupied statuses for parking spaces in the overlapping areas. Parking space lights can form a mesh communication network to relay communications to display devices.

It is to be appreciated that the parking space light can be a retrofit light bulb with instruments integrated therein. In another embodiment, the parking space light can have all or a portion of the instruments integrated into a light fixture (e.g. socket, holder, ballast) for the parking space light. A parking space light can learn about its context and customize its configuration and/or operation in accordance with the context (e.g. using artificial intelligence). This can eliminate or minimize the need for an operator (e.g. user, administrator, or any other suitable entity) to perform manual configuration. Furthermore, a set of parking space lights can automatically perform coordinated self-configuration and operation. All examples below can involve coordination amongst a set of parking space lights to achieve the capability of providing indications of quantity of unoccupied parking spaces and where those unoccupied parking spaces are located in an existing parking structure, whether explicitly stated or not. Further, although the term "parking space light" is used herein, in various embodiments, the examples provided can include one or more parking space lights operating independently or in a distributed fashion, as applicable. All such embodiments are envisaged.

While examples herein describe installation of one or more parking space lights as a retrofit install in an existing lighting system of a parking structure, it is to be appreciated the one or more parking space lights can be installed during construction of a new parking structure. In a non-limiting example, a parking structure can include a ground surface parking lot, an above ground parking garage, an underground parking garage, an above ground multi-level parking garage, an underground multi-level parking garage, a ferry boat parking structure, a boat marina, a shipping terminal, a bus terminal, a bicycle parking lot, or any other suitable vehicle parking structure. Furthermore, a parking structure can be used for vehicles, in a non-limiting example, including automobiles, motorcycles, bicycles, buses, trucks, aircrafts, watercrafts, or any other suitable vehicles.

Figure 2:
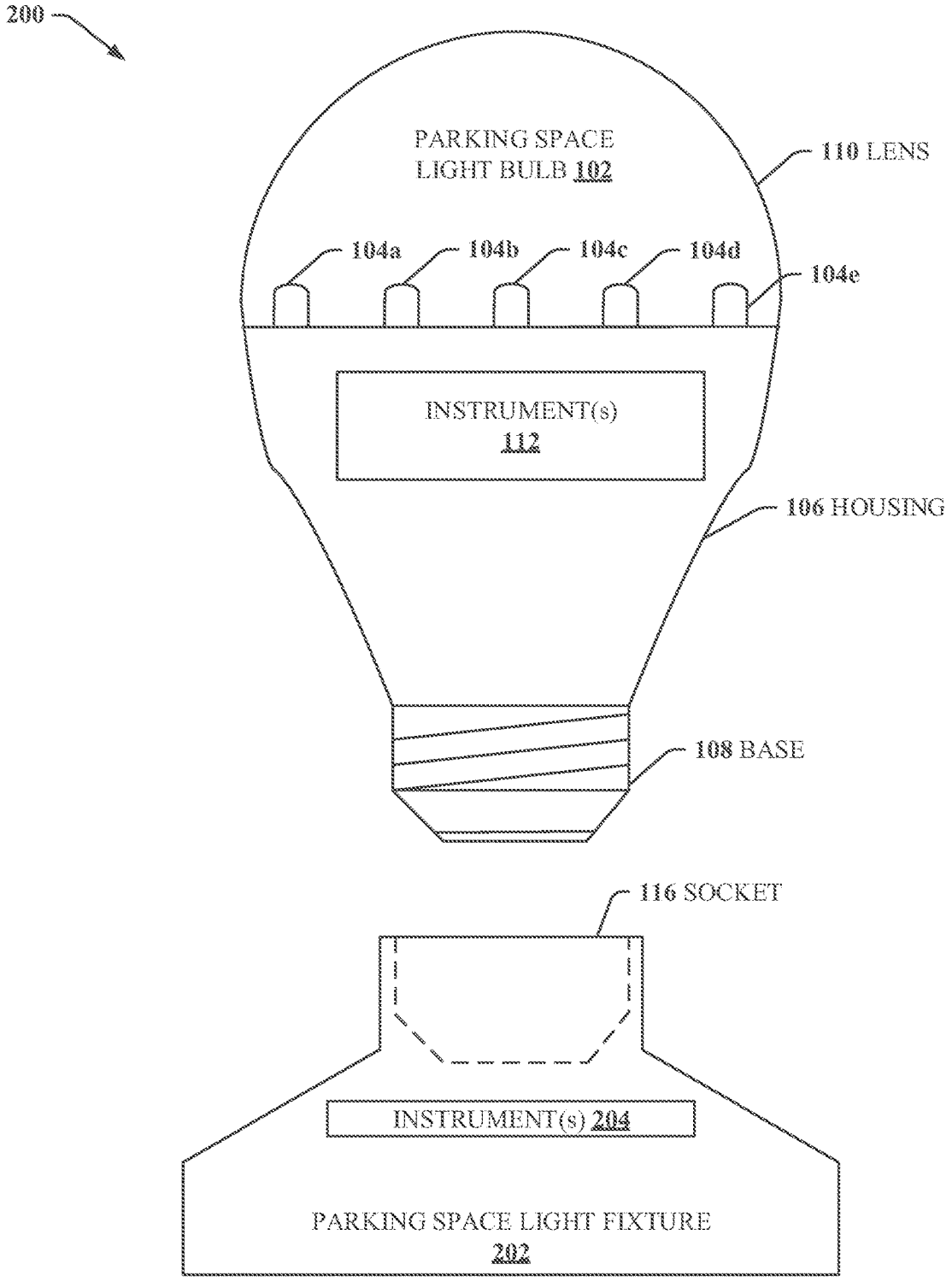
FIG. 2 illustrates a block diagram of an example, non-limiting parking space light in accordance with one or more embodiments described herein.

FIGS. 1-2 illustrate block diagrams of example, non-limiting parking space lights 100, 200 in accordance with one or more embodiments described herein. The subject disclosure is directed to computer processing systems, computer-implemented methods, apparatus and/or computer program products that facilitate efficiently, effectively, and automatically (e.g., with little or no direct involvement from an operator) employing parking space lights 100, 200 that perform self-configuration to achieve the capability of providing indications of quantity of unoccupied parking spaces and where those unoccupied parking spaces are located in an existing parking structure. For example, when installed, parking space light 100, 200 can employ sensors, tools, and communication devices to determine its place in the environment and device ecosystem and perform an auto-configuration. In an example, parking space light 100, 200 can employ sensors to understand the physical environment in which it is installed, and determine how it fits into the physical environment. In another example, parking space light 100, 200 can communicate on one or more networks to identify other parking space lights 100, 200 and other devices in the device ecosystem, and determine how it fits into the device ecosystem. Based on the determinations, parking space light 100, 200 can perform an autoconfiguration to enable the capability of providing indications of quantity of unoccupied parking spaces and where those unoccupied parking spaces are located in an existing parking structure. It is to be appreciated that a user interface (not shown) can be provided that allows an operator to manually adjust the configuration generated by the parking space light 100, 200.

In order to facilitate self-configuration, parking space lights 100, 200 described herein can be employed that are communicating with each other, communicating with another device. The parking space lights 100, 200 can coordinate amongst themselves to make decisions regarding actions to be taken by the parking space lights 100, 200. Parking space lights 100, 200 can receive instructions from another device, such as a control system, regarding actions to be taken by the Parking space lights 100, 200. Parking space lights 100, 200 can receive instructions from an operator, regarding actions to be taken by the parking space lights 100, 200. A parking space light 100, 200 can autonomously make decisions regarding actions to be taken by the parking space light 100, 200. It is to be appreciated that parking space lights 100, 200 can employ any of the aforementioned decision-making methods, alone or in combination, regarding actions to be taken by the parking space lights 100, 200.

FIG. 1 illustrates a block diagram of an example, non-limiting parking space light 100 in accordance with one or more embodiments described herein. Parking space light 100 comprises a parking space light bulb 102 which can be installed as a retrofit into a socket 116 of conventional light fixture 114. Parking space light bulb 102 comprises one or more light emitting devices 104*a*, 104*b*, 104*c*, 104*d*, and 104*e* (e.g. light emitting diode (LED), organic light emitting diode (OLED), filament, quantum dot, incandescent, high-intensity discharge (HID), neon, fluorescent, compact fluorescent (CFL), electroluminescent (EL), laser, or any other suitable light emitting device) a housing 106, a base 108, a lens 110, and one or more instruments 112. It is to be appreciated that while five light emitting devices 104*a*, 104*b*, 104*c*, 104*d*, and 104*e* are depicted for illustrative purposes only, parking space light bulb 102 can include any suitable number of light emitting devices. It is also to be appreciated that parking space light bulb 102 can include other components (not shown) or exclude one or more components. For example, parking space light bulb 102 can exclude lens 110. In another example, parking space light bulb 102 can include one or more reflectors, one or more shades, one or more positioning motors, or any other suitable components needed according to functionality described herein.

FIG. 2 illustrates a block diagram of an example, non-limiting parking space light 200 in accordance with one or more embodiments described herein. Parking space light 100 comprises a parking space light bulb 102 which can be installed into a socket 116 of a parking space light fixture 202. Parking space light fixture 202 comprises one or more instruments 204. It is to be appreciated that parking space light fixture 202 can include other components (not shown) or exclude one or more components. For example, parking space light fixture 202 can include one or more light emitting devices, one or more reflectors, one or more shades, one or more positioning motors, or any other suitable components needed according to functionality described herein. It is to be appreciated that parking space light bulb 102 can communicate with parking space light fixture 202 via wired or wireless communications. For example, base 108 connecting to socket 116 can form a wired communication connection.

While FIGS. 1-2 depict a parking space light bulb 102 fitting into a light fixture 114, 202, it is to be appreciated that a single light fixture 114, 202 can comprise a plurality of sockets 116 for installation of a plurality of parking space light bulbs 102.

Figure 3:
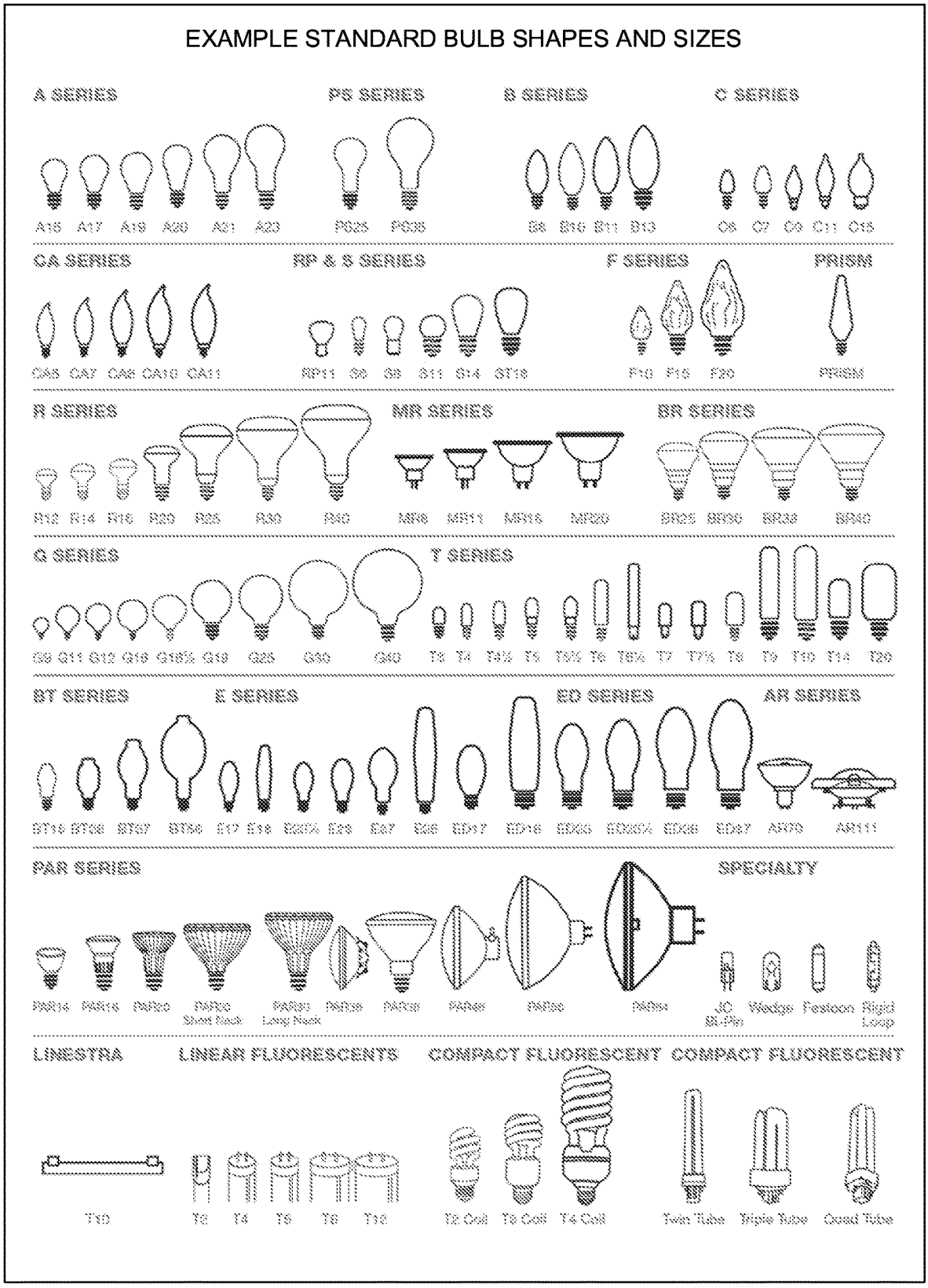
FIG. 3 illustrates example, non-limiting standard bulb shapes and size for parking space light bulb in accordance with one or more embodiments described herein.

FIG. 3 illustrates example, non-limiting standard bulb shapes and size for parking space light bulb 102. It is to be appreciated that parking space light bulb 102 can be customized to be in any suitable shape and any suitable size for an application in which parking space light bulb 102 is to be installed.

Figure 4:
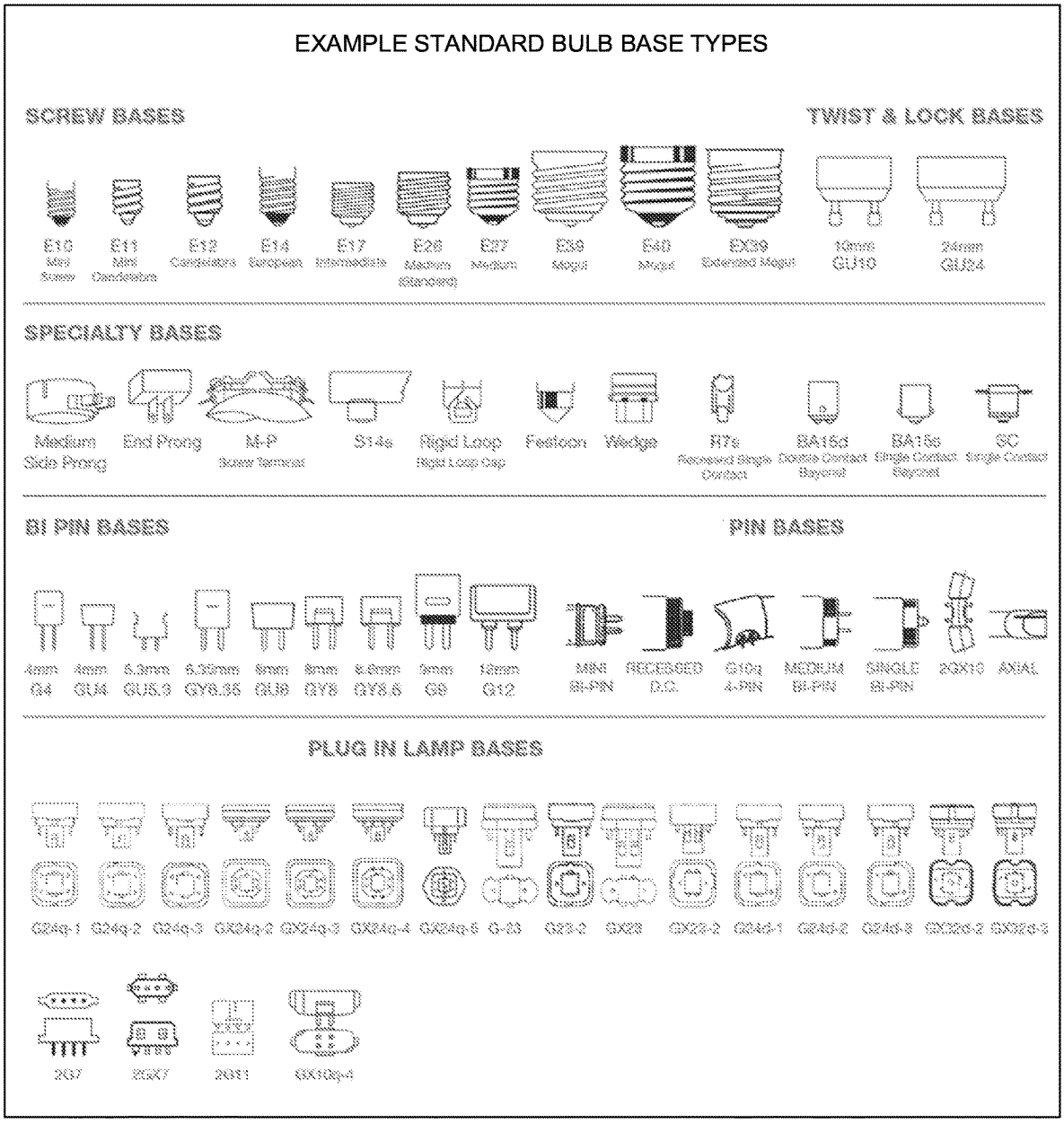
FIG. 4 illustrates example, non-limiting standard base types for base of parking space light bulb in accordance with one or more embodiments described herein.

FIG. 4 illustrates example, non-limiting standard base types for base 108. It is to be appreciated that base 108 can be customized to be in any suitable form for an application in which parking space light bulb 102 is to be installed. Likewise, socket 116 can be customized to be compatible with base 108. Additionally, parking space light fixture 202 can be customized to be in any suitable form for an application in which parking space light 200 is to be installed.

A parking space light 100, 200 can include a power source, non-limiting examples of which include electrical grid power, battery, electrochemical cell, fuel cell, natural gas generated electric power, compressed air generated electric power, diesel fuel generated electric power, gasoline generated electric power, oil generated electric power, propane generated electric power, nuclear power system, solar power system, wind power system, piezoelectric power system, micro-electrical mechanical systems (MEMS)-generated electric power, inductive power system, radio-frequency power system, wireless power transfer mechanism, or any other suitable power source. In an example, a parking space light 100, 200 can have a constantly available power source, such as that provided by an electrical power grid. In another example, a parking space light 100, 200 can have a temporary power source, such as a battery (e.g. disposable battery or rechargeable battery). In a further example, a parking space light 100, 200 can generate and store its own power, such as by solar, fuel cell, radio-frequency harvesting, induction, piezoelectric, electro-mechanical, chemical, nuclear, carbon based-fuel, or any other suitable self-generating power source. This is advantageous for long-term installations (e.g. where frequent battery changes would be required) that do not have a constantly available power source, such as an outdoor environment where a power outlet is not available (e.g., a yard, a camping site, a farm field, a park, a sports field, etc.), or an indoor location where a power outlet is not available. It is to be appreciated that parking space light 100, 200 can have a plurality of different power sources, with one or more power sources acting as a backup for another power source. It is to be appreciated that parking space light 100, 200 can have configurable power sources. For example, parking space light 100, 200 can have a modular configuration that allows for one or more power sources to be added or removed by a manufacturer or operator.

A parking space light 100, 200 can include one or more computers, one or more processors, one or more memories, and one or more programs. A parking space light 100, 200 can communicate via any suitable form of wireless or wired communication using a communication device. Non-limiting examples of wireless communication can include radio communication, optical communication, sonic communication, electromagnetic induction communication, or any other suitable wireless communication. A parking space light 100, 200 can include one or more instruments 112, 204, non-limiting examples of which include a communication device, a radio frequency identification (RFID) reader, a navigation device, a camera, a video camera, a three-dimensional camera, a global positioning system (GPS) device, a motion sensor, a radar device, a temperature sensor, a weather sensor, a humidity sensor, a barometer, a Doppler radar, a light sensor, a thermal imaging device, an infrared camera, an audio sensor, an ultrasound imaging device, a light detection and ranging (LIDAR) sensor, sound navigation and ranging (SONAR) device, a microwave sensor, a chemical sensor, a radiation sensor, an electromagnetic field sensor, a pressure sensor, a spectrum analyzer, a scent sensor, a moisture sensor, a biohazard sensor, a touch sensor, a gyroscope, an altimeter, a microscope, magnetometer, a device capable is seeing through or inside of objects, or any other suitable sensors. In addition, instruments 112, 204 can include tools, non-limiting examples of which include, a projectile launcher, a liquid sprayer, an air blower, a flame thrower, a heat projector, a cold projector, a scent projector, a chemical projector, an electric discharge device, a fire extinguisher, a laser, or any other suitable tools to perform any task. Additionally, instruments 112, 204 can include a display screen, a video projector, an audio speaker, or any other suitable instrument. It is to be appreciated that parking space light 100, 200 can have configurable instruments. For example, parking space light 100, 200 can have a modular configuration that allows for one or more instruments to be added or removed by a manufacturer or operator.

A parking space light 100, 200 can be constructed out of any suitable material appropriate for environments in which the parking space light 100, 200 will operate. A parking space light 100, 200 can have suitable protection against an environment in which the parking space light 100, 200 will operate, non-limiting examples of which include weather resistant, crush resistant, fire resistant, heat resistant, cold resistant, pressure resistant, impact resistant, liquid and/or solid material ingress protection, chemical resistant, corrosion resistant, shatter resistant, scratch resistant, bio-contamination resistant, electromagnetic pulse resistant, electrical shock resistant, projectile resistant, explosion resistant, or any other suitable resistance for an environment in which the parking space light 100, 200 will operate.

The computer processing systems, computer-implemented methods, apparatus and/or computer program products of parking space light 100, 200 employ hardware and/or software to solve problems that are highly technical in nature (e.g., related to complex coordination of one or more parking space lights 100, 200 possibly with other device to perform self-configuration and operation of the one or more parking space lights 100, 200) that are not abstract and that cannot be performed as a set of mental acts by a human One or more embodiments of the subject computer processing systems, methods, apparatuses and/or computer program products enable one or more parking space lights 100, 200 to coordinate amongst themselves, and optionally with other devices, to perform actions to understand the environment in which the one or more parking space lights 100, 200 is installed, and perform a self-configuration to achieve the capability of providing indications of quantity of unoccupied parking spaces and where those unoccupied parking spaces are located in an existing parking structure. For example, the parking space lights 100, 200 can employ artificial intelligence to learn their environment, and learn actions to perform to self-configuration and operate to achieve the capability of providing indications of quantity of unoccupied parking spaces and where those unoccupied parking spaces are located in an existing parking structure.

Figure 5:
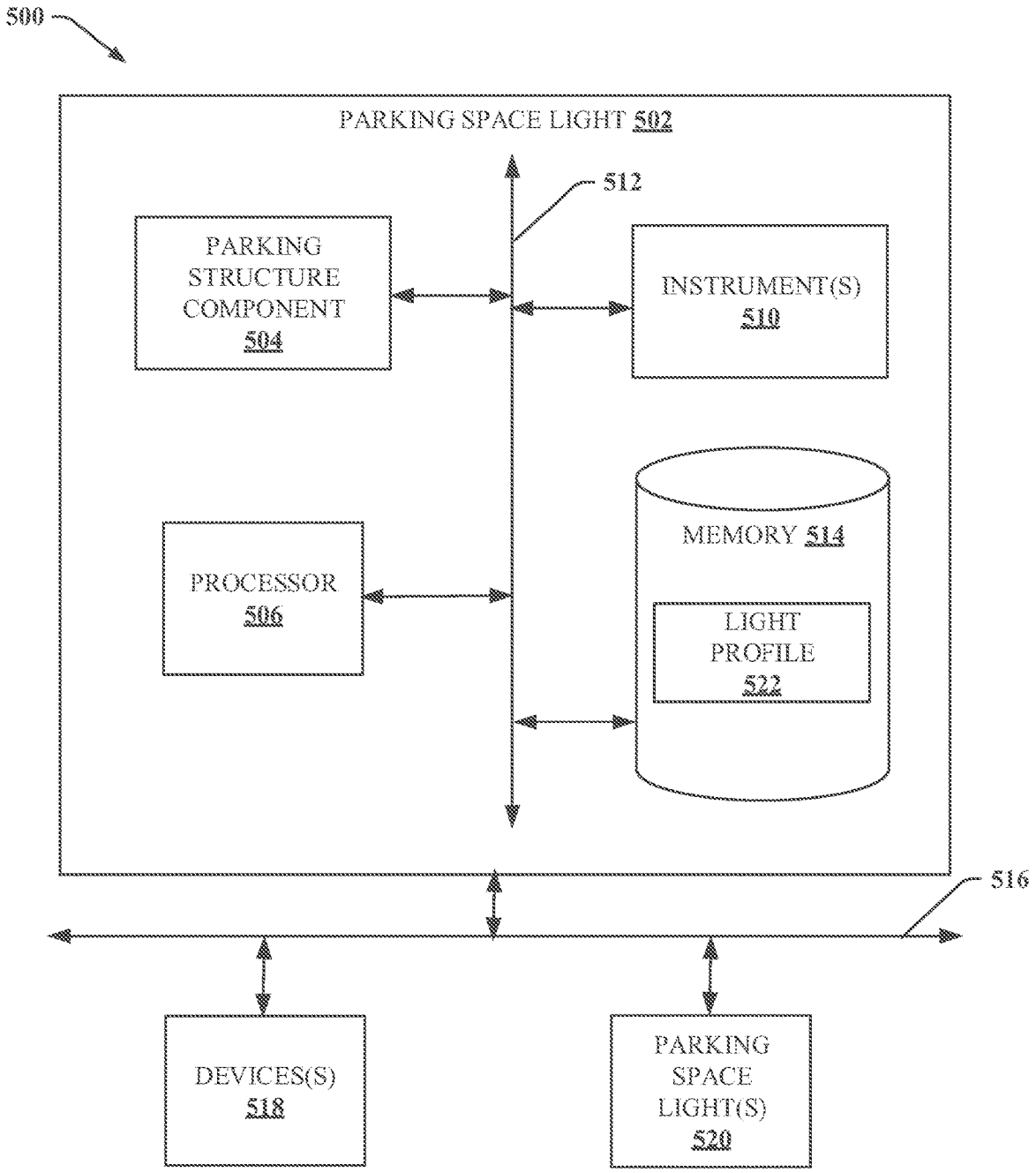
FIG. 5 illustrates a block diagram of an example, non-limiting parking space light in accordance with one or more embodiments described herein.

FIG. 5 illustrates a block diagram of an example, non-limiting system 500 that facilitates a parking space light 502 to understand a parking structure's environment in which the parking space light 502 is installed, and perform a self-configuration and operate to achieve the capability of providing indications of quantity of unoccupied parking spaces and where those unoccupied parking spaces are located in the parking structure in accordance with one or more embodiments described herein. Repetitive description of like elements employed in other embodiments described herein is omitted for sake of brevity.

In some embodiments, the system 500 facilitates a plurality of parking space lights 502, 520 coordinating together to understand the parking structure's environment in which the parking space lights 502, 520 are installed, and perform self-configuration and operate to achieve the capability of providing indications of quantity of unoccupied parking spaces and where those unoccupied parking spaces are located in the parking structure in accordance with one or more embodiments described herein. Aspects of systems (e.g., system 500 and the like), apparatuses or processes explained in this disclosure can constitute machine-executable component(s) embodied within machine(s), e.g., embodied in one or more computer readable mediums (or media) associated with one or more machines. Such component(s), when executed by the one or more machines, e.g., one or more computers, one or more computing devices, one or more virtual machines, etc., can cause the one or more machines to perform the operations described.

As shown in FIG. 5, the system 500 can include parking space lights 502, 520, one or more networks 516, and one or more devices 518. In various embodiments, parking space lights 502, 520 can be or include the structure and/or functionality of one or more of parking space lights 100 or 200 and/or any other structure and/or functionality described herein for parking space lights. In one example, parking space light 502 can be a different type of parking space light than parking space light 520. In another example, a parking space light 520 can be a parking space light 502 and/or include one or more components of parking space light 502. It is to be appreciated that in disclosures herein in which more than one parking space light is employed, the parking space lights can include one or more of parking space light 502 and/or parking space light 520.

Parking space light 502 can include instruments 510, which can include or be one or more of numerous different types of instruments 112, 204 disclosed herein. Parking space light 502 can communicate with other parking space lights 520 and devices 518 over one or more networks 516 via wireless and/or wired communications using instruments 510. Parking space light 502 can include parking structure component 504 that can enable parking space light 502 to understand the parking structure environment in which the parking space light 502 is installed, and perform a self-configuration and operate to achieve the capability of providing indications of quantity of unoccupied parking spaces and where those unoccupied parking spaces are located in the parking structure.

Parking space light 502 can include or otherwise be associated with at least one memory 514 that can store computer executable components (e.g., computer executable components can include, but are not limited to, the parking structure component 504, and/or associated components), and can store any data generated or obtained by parking space light 502 and associated components. Memory 514 can store a light profile 522 that describes one or more characteristics of the parking structure environment, and capabilities and configuration of parking space light 502. Parking space light 502 can also include or otherwise be associated with at least one processor 506 that executes the computer executable components stored in the memory 514. Parking space light 502 can further include a system bus 512 that can couple the various components including, but not limited to, parking structure component 504, instruments 510, memory 514, processor 506, and/or other components.

Device 518 can be any electronic device that can electronically interact (e.g. unidirectional interaction or bidirectional interaction) with parking space light 502, non-limiting examples of which can include a wearable electronic device or a non-wearable electronic device. It is to be appreciated that interaction can include in a non-limiting example, communication, control, physical interaction, or any other suitable interaction between devices. Wearable device can include, for example, heads-up display glasses, a monocle, eyeglasses, contact lens, sunglasses, a headset, a visor, a cap, a mask, a headband, clothing, or any other suitable device that can be worn by a human or non-human user that comprises electronic components. Non-wearable devices can include, for example, a mobile device, a mobile phone, a camera, a camcorder, a video camera, laptop computer, tablet device, desktop computer, server system, cable set top box, satellite set top box, cable modem, television set, monitor, media extender device, blu-ray device, DVD (digital versatile disc or digital video disc) device, compact disc device, video game system, portable video game console, audio/video receiver, radio device, portable music player, navigation system, car stereo, a mainframe computer, a robotic device, an artificial intelligence system, a security system, a messaging system, a presentation system, a sound system, a warning system, a fire suppression system, a lighting system, a network storage device, a communication device, a web server device, a network switching device, a network routing device, a gateway device, a network hub device, a network bridge device, a control system, or any other suitable device. Device 518 can be equipped with a communication device that enables device 518 to communicate with parking space light 502 and/or 520 over network 516. It is to be appreciated that a device 518 can be employed by an operator to interact with a parking space light 502 and/or 520.

The various components (e.g., parking structure component 504, instruments 510, memory 514, processor 506, parking space lights 502, 520, and/or other components) of system 500 can be connected either directly or via one or more networks 516. Such networks 516 can include wired and wireless networks, including, but not limited to, a cellular network, a wide area network (WAN) (e.g., the Internet), or a local area network (LAN), non-limiting examples of which include cellular, WAN, wireless fidelity (Wi-Fi), Wi-Max, WLAN, radio communication, microwave communication, satellite communication, optical communication, sonic communication, electromagnetic induction communication, or any other suitable communication technology.

Figure 6:
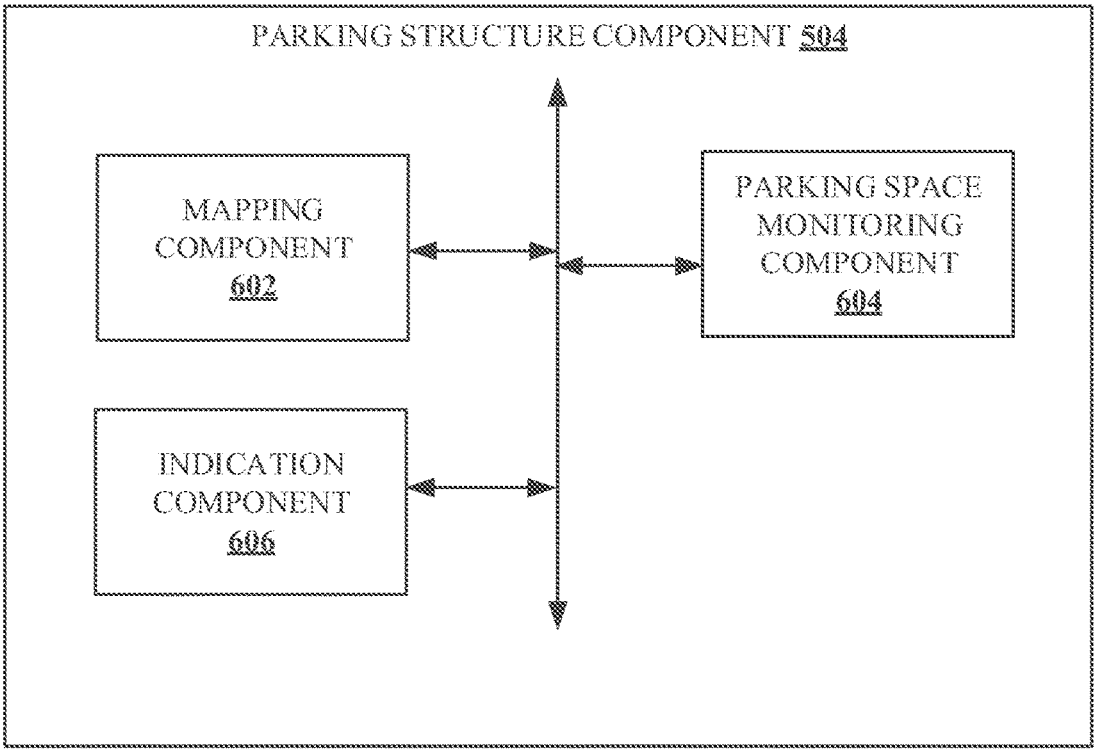
FIG. 6 illustrates a block diagram of an example, non-limiting parking structure component in accordance with one or more embodiments described herein.

FIG. 6 illustrates a block diagram of an example, non-limiting parking structure component 504 that can facilitate parking space light 502 to determine (e.g., ascertain, infer, calculate, predict, prognose, estimate, derive, forecast, detect, and/or compute) characteristics of the parking structure environment in which the parking space light 502 is installed, determine capabilities of parking space light 502, and perform a self-configuration of parking space light 502 and operate to achieve the capability of providing indications of quantity of unoccupied parking spaces and where those unoccupied parking spaces are located in an existing parking structure in accordance with one or more embodiments described herein. Repetitive description of like elements employed in other embodiments described herein is omitted for sake of brevity.

Parking structure component 504 can include mapping component 602 that can determine characteristics of the parking structure environment in which the parking space light 502 is installed, and can determine capabilities of parking space light 502. Parking structure component 504 can also include parking space monitoring component 604 that can perform a self-configuration of parking space light 502 according to light profile 522, and operate to monitor parking spaces in a defined region with respect to parking space light 502. Parking structure component 504 can also include indication component 606 that can generate suitable indications for parking space light 502 based on conditions of the monitored parking spaces.

Mapping component 602 can employ one or more instruments 510 to obtain information about the parking structure environment in which the parking space light 502 is installed and determine characteristics of the environment. In a non-limiting embodiment, characteristics can include parking spaces, parking space identifiers, vehicles, objects, devices, people, fauna, flora, colors, dimensional characteristics, locations, topography, landscape, seascape, boundaries, manmade features, equipment, machines, buildings, grounds, roads, railroad tracks, water features, rocks, trees, debris, geographic features, property line boundary, network topology, or any other suitable characteristics of the environment that can be determined from information obtained by instruments 510.

Mapping component 602 can employ the obtained information to produce a map of a portion of the parking structure environment in which the parking space light 502 is installed. A plurality of parking space lights 502, 520 installed in the parking structure can generate respective maps. Mapping component 602 can combine the respective maps to generate an overall map of the parking structure environment. It is to be appreciated that one or more parking space lights 502, 520 can generate the overall map of the parking structure environment. In another example, parking space lights 502, 520 can cooperate to elect a parking space light 502, 520 to act as a master, while the other parking space lights 502, 520 can act as slaves to the master parking space light 502, 520. The master parking space light 502, 520 can generate the overall map of the parking structure environment.

It is to be appreciated that mapping component 602 can employ intelligent recognition techniques (e.g., spatial relationship recognition, pattern recognition, object recognition, facial recognition, animal recognition, pose recognition, action recognition, shape recognition, scene recognition, behavior recognition, sound recognition, scent recognition, voice recognition, audio recognition, image recognition, motion recognition, hue recognition, feature recognition, edge recognition, texture recognition, timing recognition, location recognition, and/or any other suitable recognition technique) to determine characteristics based on information obtained by one or more instruments 510.

Mapping component 602 can obtain physical information about the physical environment in which parking space light 502 is installed. In an example, mapping component 602 can employ a camera to obtain visual information about the environment. In another example, mapping component 602 can employ a microphone to obtain audio information about the environment. In a further example, mapping component 602 can employ a GPS device to obtain its location in the environment. In another example, mapping component 602 can employ an LIDAR sensor to obtain mapping information about the environment. In an additional example, mapping component 602 can employ GPS device and LIDAR sensor to map the locations of characteristics recognized in the environment. In addition, mapping component 602 can recognize parking space identifiers, such as in a non-limiting example, parking space numbers in captured images, GPS coordinates of parking spaces, or any other suitable parking space identifiers. It is to be appreciated that mapping component 602 can employ any suitable instrument 510 to obtain corresponding information produced by the instrument 510 about the physical environment.

Mapping component 602 can also obtain information about the network environment in which parking space light 502 is installed. In an example, mapping component 602 can employ a communication device to discover communication networks operating in the environment. Mapping component 602 can connect to one or more of the networks using suitable security and authentication schemes and obtain device information about devices 518 and/or parking space lights 520 operating on the networks. In a non-limiting example, device information can comprise device type, device model number, device location, device functionality, device configuration, device security, communication protocols supported, or any other suitable attribute of a device 518. It is to be appreciated that mapping component 602 can employ suitable security techniques to prevent unauthorized access to parking space light 502 while obtaining device information on other devices 518 on the one or more networks. Parking space light 502 can determine what security and/or communication protocols it should employ and self-configure for operation using the appropriate security and/or communication protocols. It is to be appreciated that one or more parking space lights 502, 520 and/or one or more device 518 can form a mesh communication network.

Mapping component 602 can store the map of the portion of the parking structure environment and/or the overall map of the parking structure environment in light profile 522. Parking space light 502 can communicate the map of the portion of the parking structure environment and/or the overall map of the parking structure environment to one or more other parking space lights 502, 520 in the parking structure environment.

Mapping component 602 can employ intelligent recognition techniques to recognize characteristics of the environment based on the physical information and the device information. In an additional example, mapping component 602 can associate device information obtained from devices 518 with corresponding physical information associated with the devices 518 obtained from sensors. Mapping component 602 can also employ knowledge resources (e.g., internet, libraries, encyclopedias, databases, devices 518, or any other suitable knowledge resources) to obtain detailed information describing the characteristics. For example, mapping component 602 can obtain detailed product information related to recognized characteristics of the environment. Mapping component 602 can obtain any suitable information associated with recognized characteristics of the environment from any suitable knowledge resource.

Furthermore, mapping component 602 can generate a confidence metric indicative of a confidence of a determination of a characteristic that has been made by mapping component 602 based on any suitable function. For example, mapping component 602 can employ the multiple sources of information (e.g., physical information, device information, and information from knowledge sources) and perform a cross-check validation across the various sources to generate a confidence metric indicative of a confidence of an accuracy of a determination of a characteristic.

Figure 7A:
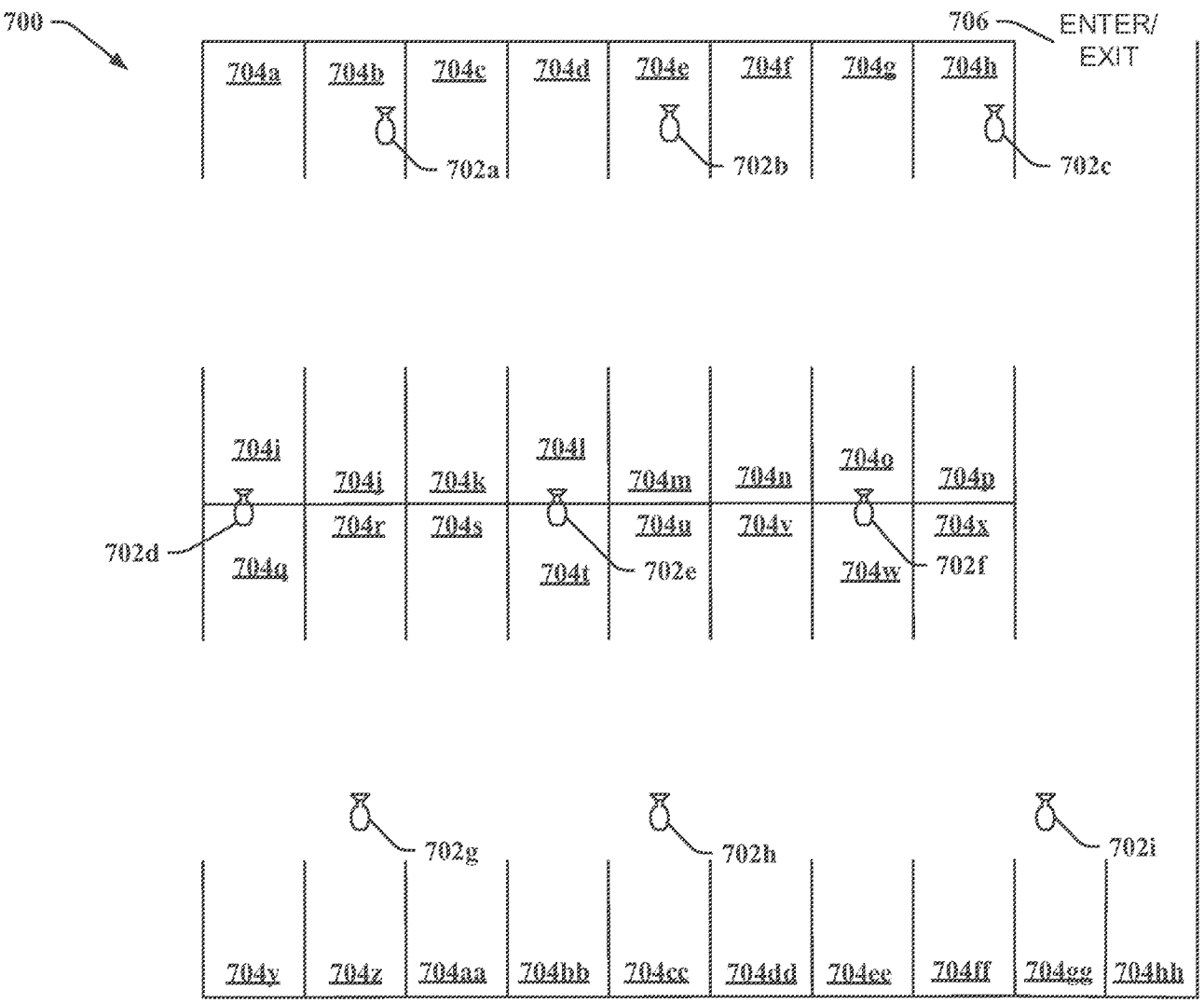
FIG. 7A illustrate a block diagram of an example, non-limiting parking structure environment in accordance with one or more embodiments described herein.

FIG. 7A illustrates a block diagram of an example, non-limiting parking structure environment 700 in which parking space lights are installed in accordance with one or more embodiments described herein. For exemplary purposes only, parking structure environment 700 is depicted as a single level parking structure. It is to be appreciated that parking space lights can be installed in any suitable parking structure as described above. Parking structure Environment 700 has installed parking space lights 702*a*, 702*b*, 702*c*, 702*d*, 702*e*, 702*e*, 702*f*, 702*g*, 702*h*, and 702*i*, which can respectively be or include portions of parking space light 502, 520. While FIG. 7 depicts nine parking space lights for exemplary purposes, it is to be appreciated that any suitable quantity of parking space lights can be installed in a parking structure environment.

Parking space lights 702*a*, 702*b*, 702*c*, 702*d*, 702*e*, 702*e*, 702*f*, 702*g*, 702*h*, and 702*i* can employ instruments 510 to determine characteristics of parking structure environment 700 in which it is installed. It is to be appreciated that the region around a parking space light for which characteristics can be determined can be dependent on the types of instruments 510 available in the parking space light. For example, parking space light 702*a* can employ sensors to obtain physical information and recognize characteristics, such as parking spaces 704*a*, 704*b*, and 704*c*. In a further example, parking space light 702*a* can determine usage of characteristics over time, dimensional information of the characteristics, locations of characteristics, traffic in the environment, changes to characteristics over time, or any other suitable physical information that can be obtained from sensors. Additionally, parking space light 702*a* can determine that it is located above parking space 704*b* and to the sides of parking spaces 704*a* and 704*c*. Parking space light 702*a* can generate a map of a portion of parking structure environment 700 in which it is installed.

In another example, parking space light 702*a* can employ communication devices to determine and establish communications on networks (e.g. Wi-Fi, radio, cellular, etc.), such as one or more networks on which parking space lights 702*b*, 702*c*, 702*d*, 702*e*, 702*e*, 702*f*, 702*g*, 702*h*, and 702*i* are communicating and obtain device information from parking space lights 702*b*, 702*c*, 702*d*, 702*e*, 702*e*, 702*f*, 702*g*, 702*h*, and 702*i*. Parking space light 702*a* can also communicate with one or more knowledge sources to obtain information about characteristics of parking structure environment 700. It is to be appreciated that parking space light 702*a* can also establish a direct communication link (e.g., not through a network) with one or more of parking space lights 702*b*, 702*c*, 702*d*, 702*e*, 702*e*, 702*f*, 702*g*, 702*h*, and 702*i* to obtain device information. Parking space light 902*a* can also establish communications with one or more of parking space lights 702*b*, 702*c*, 702*d*, 702*e*, 702*e*, 702*f*, 702*g*, 702*h*, and 702*i* and obtain information about parking structure environment 700 that those parking space lights have determined. Parking space light 702*a* can determine based on the information (e.g. physical information, device information, and/or information from knowledge sources) characteristics of parking structure environment 700. Parking space light 702*a* can generate an overall map of parking structure environment 700 based on obtained information. Furthermore, parking space light 902*a* can store the characteristics and maps of parking structure environment 700 in light profile 522.

Parking space lights 702*b*, 702*c*, 702*d*, 702*e*, 702*e*, 702*f*, 702*g*, 702*h*, and 702*i* can similarly employ instruments 510 to determine characteristics and maps of parking structure environment 700. For example, parking space light 702*b* can recognize parking spaces 704*d*, 704*e*, and 704*f*. Parking space light 702*c* can recognize parking spaces 704*g*, 704*h*, and enter/exit 706 of parking structure environment 700. Parking space light 702*d* can recognize parking spaces 704*i*, 704*j*, 704*q*, and 704*r*. Parking space light 702*e* can recognize parking spaces 704*k*, 7041, 704*m*, and 704*s*, 704*t*, and 704*u*. Parking space light 702*f* can recognize parking spaces 704*n*, 704*o*, 704*p*, and 704*v*, 704*w*, and 704*x*. Parking space light 702*g* can recognize parking spaces 704*y*, 704*z*, and 704*aa*. Parking space light 702*h* can recognize parking spaces 704*bb*, 704*cc*, and 704*dd*. Parking space light 702*i* can recognize parking spaces 704*ee*, 704*ff*, 704*gg*, and 704*hh*.

It is to be appreciate that parking space lights can determine characteristics in overlapping regions based on capabilities of their instruments 510. For example, the region which an instrument 510 of a first parking space light can perform detection can overlap with a region which an instrument 510 of a second parking space light can perform detection. In a non-limiting example, parking space light 702*a* can detect parking space 704*d* which is also detected by parking space light 702*b*.

It is also to be appreciate that parking space lights can determine characteristics in regions not completely covered by detection capabilities of their instruments 510. For example, a portion of the environment can have a blind spot to the parking space lights. The parking space lights can perform an inference to determine characteristics of the blind spot based on characteristics that are able to be detected by the parking space lights. In an example, parking space light 702*h* can detect a portion of parking space 704*ee*, while parking space light 702*i* can detect another portion of parking space 704*ee* that does not overlap with the portion of parking space 704*ee* detected by parking space light 702*h*. Parking space lights 702*h* and 702*i* can share data to infer information about parking space 704*ee* (e.g., dimensions, location, unoccupied space, occupied space, etc.)

Mapping component 602 can also perform a self-examination to determine capabilities of parking space light 502. For example, mapping component 602 can determine capabilities, such as in a non-limiting example, power sources, computers, processors 506, memories 514, programs, instruments 112, 204, or any other suitable capability of parking space light 502. In an example, mapping component 602 can probe system bus 512 to determine capabilities of parking space light 502. In another example, mapping component 602 can examine memory 514 for information on capabilities of parking space light 502. In a further example, mapping component 602 can obtain information on capabilities of parking space light 502 from one or more knowledge sources. It is to be appreciated that mapping component 602 can employ any suitable mechanism to determine capabilities of parking space light 502.

Mapping component 602 can store the characteristics and any associated obtained information in light profile 522 to describes the characteristics of the environment. The light profile 522 can be organized in any suitable manner, non-limiting examples of which include an array, a table, a tree, a map, graph, a chart, a list, network topology, or any other suitable manner of organizing data in a profile. In a non-limiting example, mapping component 602 can include respective entries for each characteristic of the environment that comprise a detailed description of the characteristic, a location of the characteristic in the environment, tracking information describing changes to the characteristic over time, source used to determine the characteristic, confidence of accuracy of the determined characteristic, or any other suitable information associated with the characteristic. Mapping component 602 can generate the map of the environment identifying characteristics and their locations on the map.

Referring back to FIG. 6, parking structure component 504 can include parking space monitoring component 604 that can configure settings of one or more parameters of parking space light 502 (e.g., of processors, memory, programs, instruments 510, parking space light bulb 102, parking space light fixture 202, housing 106, lens 110, light emitting devices, base 108, socket 116, or any other suitable parameters of components of parking space lights 502) to achieve the capability of providing indications of quantity of unoccupied parking spaces and where those unoccupied parking spaces are located in an existing parking structure, and store the settings in light profile 522. In another example, an operator can employ a user interface (not shown) of an application on a device 518 to enter information overriding data in light profile 522, and/or actions determined by parking space light 502.

Parking space monitoring component 604 can establish a defined region of the parking structure environment to be monitored by parking space light 502. In a non-limiting example, a defined region can be a set of parking spaces, a defined portion of a map of the parking structure environment, a defined geographical area, a defined three-dimensional area, or any other suitable defined region of the parking structure environment. Parking space monitoring component 604 can employ instruments 510 to monitor the defined region and parking spaces within the defined region to determine whether the respective parking spaces are unoccupied or occupied. For example, parking space monitoring component 604 can employ a camera, radar, LIDAR, motion sensors, or any other suitable instrument 510 to detect whether a vehicle or some other object is occupying a parking space. It is to be appreciated that parking space monitoring component 604 can employ artificial intelligence techniques to determine whether a vehicle or some other object is occupying a parking space. For example, parking space monitoring component 604 can employ intelligent recognition techniques to recognize a vehicle or object in the parking space.

It is also to be appreciated that parking space monitoring component 604 can determine whether a detected object in a parking space would prevent parking in the space or not prevent parking in the space. For example, a person standing in the parking space can be determined by parking space monitoring component 604 to not prevent parking in the parking space, because the person can move when a vehicle attempt to park in the parking space, and thus the parking space can be determined to be unoccupied. In another example, a pile of bricks in a parking space can be determined by parking space monitoring component 604 to prevent parking in the parking space, and thus the parking space can be determined to be occupied.

Parking space monitoring component 604 can employ a data structure (e.g. a parking status data structure) that has entries for each parking space in the defined region and/or the parking structure environment. Parking space monitoring component 604 mark a parking space that is determined to be occupied with an occupied indication in an occupied status field of the parking status data structure for the parking space. Parking space monitoring component 604 mark a parking space that is determined to be unoccupied with an unoccupied indication in the occupied status field of the parking status data structure for the parking space.

Figure 8:
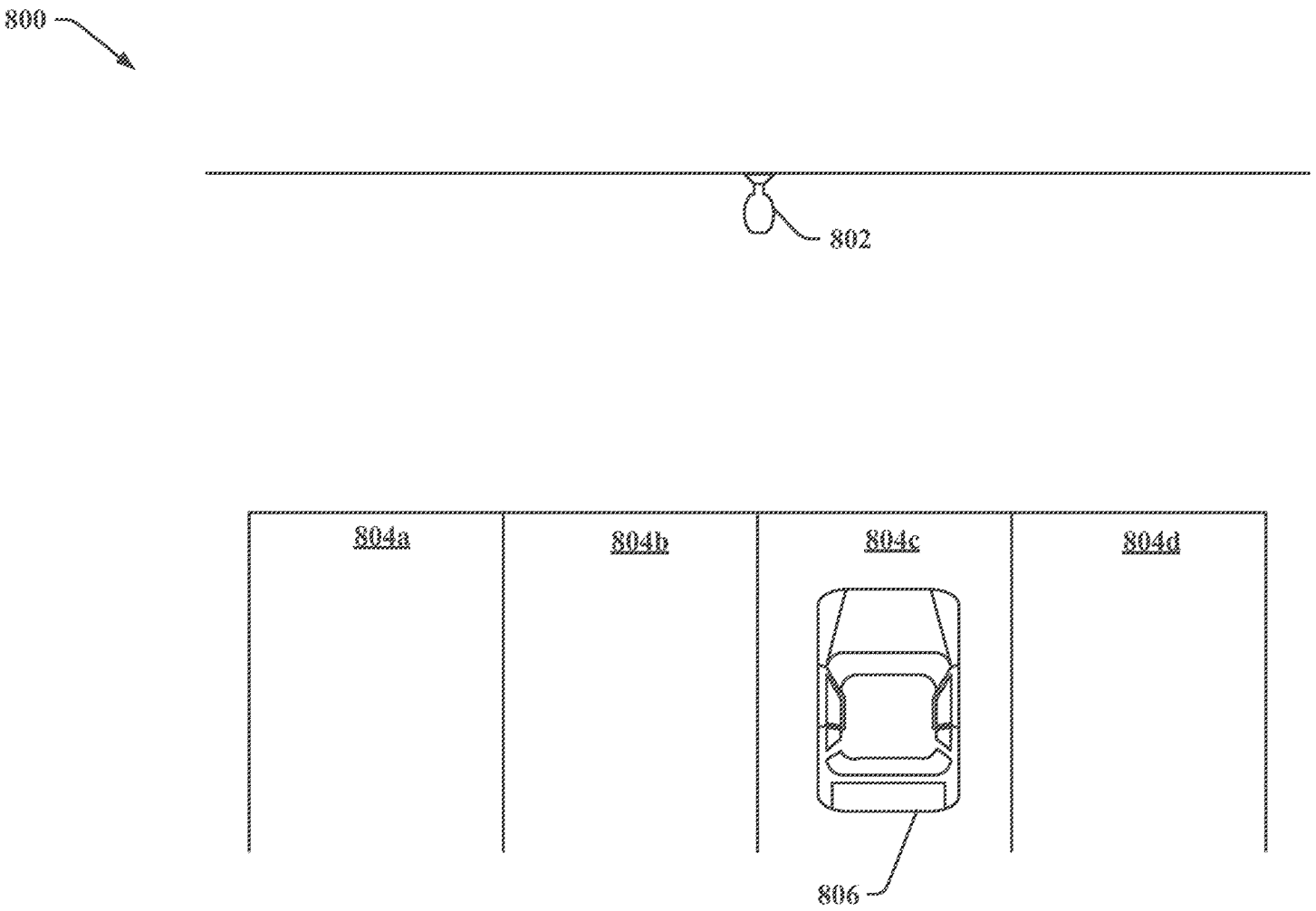
FIG. 8 illustrates a block diagram of an example, non-limiting parking structure environment in accordance with one or more embodiments described herein.

FIG. 8 illustrates a block diagram of an example, non-limiting parking structure environment 800 in which parking space light 802 is installed in accordance with one or more embodiments described herein. It is to be appreciated that parking space light 802 can be a parking space light 502 or 520. In this example, parking space monitoring component 604 can establish a defined region that includes parking spaces 804*a*, 804*b*, 804*c*, and 804*d*. Parking space monitoring component 604 can monitor the defined region and determine that parking spaces 804*a*, 804*b*, and 804*d* are unoccupied, and that parking space 804*c* is occupied by vehicle 806.

Figure 9:
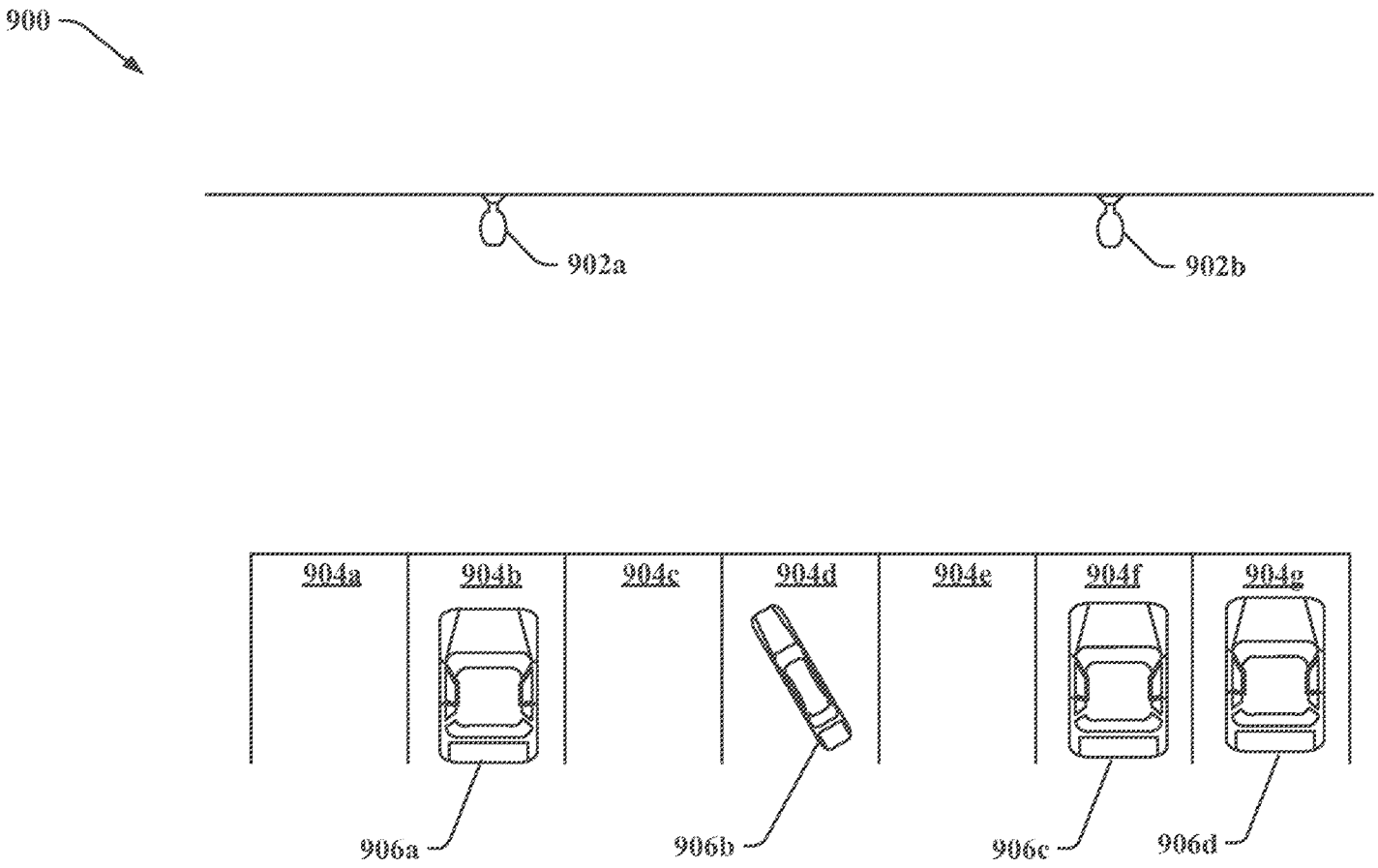
FIG. 9 illustrates a block diagram of an example, non-limiting parking structure environment in accordance with one or more embodiments described herein.

FIG. 9 illustrates a block diagram of an example, non-limiting parking structure environment 900 in which parking space lights 902*a* and 902*b* are installed in accordance with one or more embodiments described herein. It is to be appreciated that parking space lights 902*a* and 902*b* can be a parking space light 502 or 520. In this example, parking space light 902*a* can monitor all of parking spaces 904*a*, 904*b*, 904*c*, and part of parking space 904*d*. Parking space light 902*b* can monitor all of parking spaces 904*e*, 904*f*, 904*g*, and another part of parking space 904*d* that does not overlap with the part of parking space 904*d* monitored by parking space light 902*a*. Parking space lights 902*a* and 902*b* can work together to monitor parking space 904*d* and make determination as to whether parking space 904*d* is occupied of unoccupied. It is to be appreciated that parking space lights 902*a* and 902*b* can negotiate with each other to determine whether parking space lights 902*a* or 902*b* has ownership for update the parking status data structure with the status of parking space 904*d*. Furthermore, whichever of parking space lights 902*a* or 902*b* has ownership of parking space 904*d* can employ any suitable mechanism to resolve a conflict when parking space lights 902*a* or 902*b* make conflicting determinations regarding the status of parking space 904*d*. In addition, whichever of parking space lights 902*a* or 902*b* has ownership of parking space 904*d* can make inferences regarding the status of parking space 904*d* based on information gathered by parking space lights 902*a* and/or 902*b*.

Continuing with this example, parking space monitoring component 604 of parking space light 902*a* can determine that parking spaces 904*a*, and 904*c* are unoccupied, and that parking space 904*b* is occupied by vehicle 906*a*. Parking space monitoring component 604 of parking space light 902*b* can determine that parking spaces 904*f* and 904*g* are occupied by vehicles 906*c* and 906*d*, and that parking space 904*e* is unoccupied. Parking space lights 902*a* and 902*b* can work together to determine that a motorcycle 906*b* is occupying parking space 904*d* even though each can only detect a portion of motorcycle 906*b*.

It is to be appreciated that while this example describes two parking space lights working together, any suitable number of parking space lights can work together to determine status of a parking space. For example, referring back to FIG. 7A, parking space lights 702*f*, 702*h*, and 702*i* can work together to detect status of parking space 704*ee*.

For example, a parking space light may have an obstruction (e.g., a column, a duct, a beam, a vehicle, or any other suitable obstruction) that impedes the parking space light's view of a portion of a parking space. The parking space light can communicate with one or more other parking space lights that have visibility to the portion of the parking space to obtain information about the portion of the parking space from one or more instruments 510 of the other parking space lights. In this manner, the parking space light can combine the obtained information from the other parking space lights with its own information about the parking space to develop a complete view of the parking space.

One or more parking space lights 502 can populate occupied status fields in the parking space data structure with respective occupied or unoccupied indications of the parking spaces in the parking structure. In an example, each parking space light 502 can maintain occupied status fields in the parking space data structure of the parking spaces in the its defined region. In another example, a master parking space light 502 can maintain occupied status fields in the parking space data structure of the parking spaces in the entire parking structure or a subset of parking spaces in the parking structure by obtaining occupied statuses for parking spaces in defined regions from respective slave parking space lights 502. For example, there can be a master parking space light 502 on each floor of a parking structure that maintains occupied status fields in the parking space data structure of the parking spaces on their respective floors of the parking structure by obtaining occupied statuses for parking spaces in defined regions from slave parking space lights 502 on the respective floors. It is to be appreciated that parking spaces in a parking structure can be grouped into any suitable subsets for maintenance of occupied status fields by respective master parking space lights 502.

Referring back to FIG. 6, parking structure component 504 can include indication component 606 that can indications of quantity of unoccupied parking spaces and where those unoccupied parking spaces are located in an existing parking structure. Indication component 606 can access parking space data structure to determine occupied statuses of parking spaces in the defined region of parking space light 502. If indication component 606 determines that one or more parking spaces in the defined region of parking space light 502 is unoccupied based on their occupied statuses, indication component 606 can generate an indication representative of there being an unoccupied parking space in the defined region of parking space light 502. If indication component 606 determines that all parking spaces in the defined region of parking space light 502 are occupied based on their occupied statuses, indication component 606 can generate an indication representative of all parking spaces in the defined region of parking space light 502 are occupied.

In a non-limiting example, the indication can be a visual indication, an audio indication, an electronic message, or any other suitable indication. For example, indication component 606 can generate a first light output (e.g. color, pattern, intensity, etc.) indicative of occupied, and a second light output indicative of unoccupied, where the first light output is different from the second light output. In another example, indication component 606 can generate a first audio output (e.g. tone, pattern, intensity, etc.) indicative of occupied, and a second audio output indicative of unoccupied, where the first audio output is different from the second audio output. In a further example, the indication can be an electronic message sent to a device 518 (e.g. mobile phone, vehicle navigation system, vehicle display screen, etc.) associated with vehicle moving in or near the parking structure that is looking for an unoccupied parking space. For example, the electronic message can indicate a parking space identifier associated with an unoccupied parking space. In another example, the electronic message can initiate the vehicle's navigation system to provide directions to an unoccupied parking space.

Figure 10A:
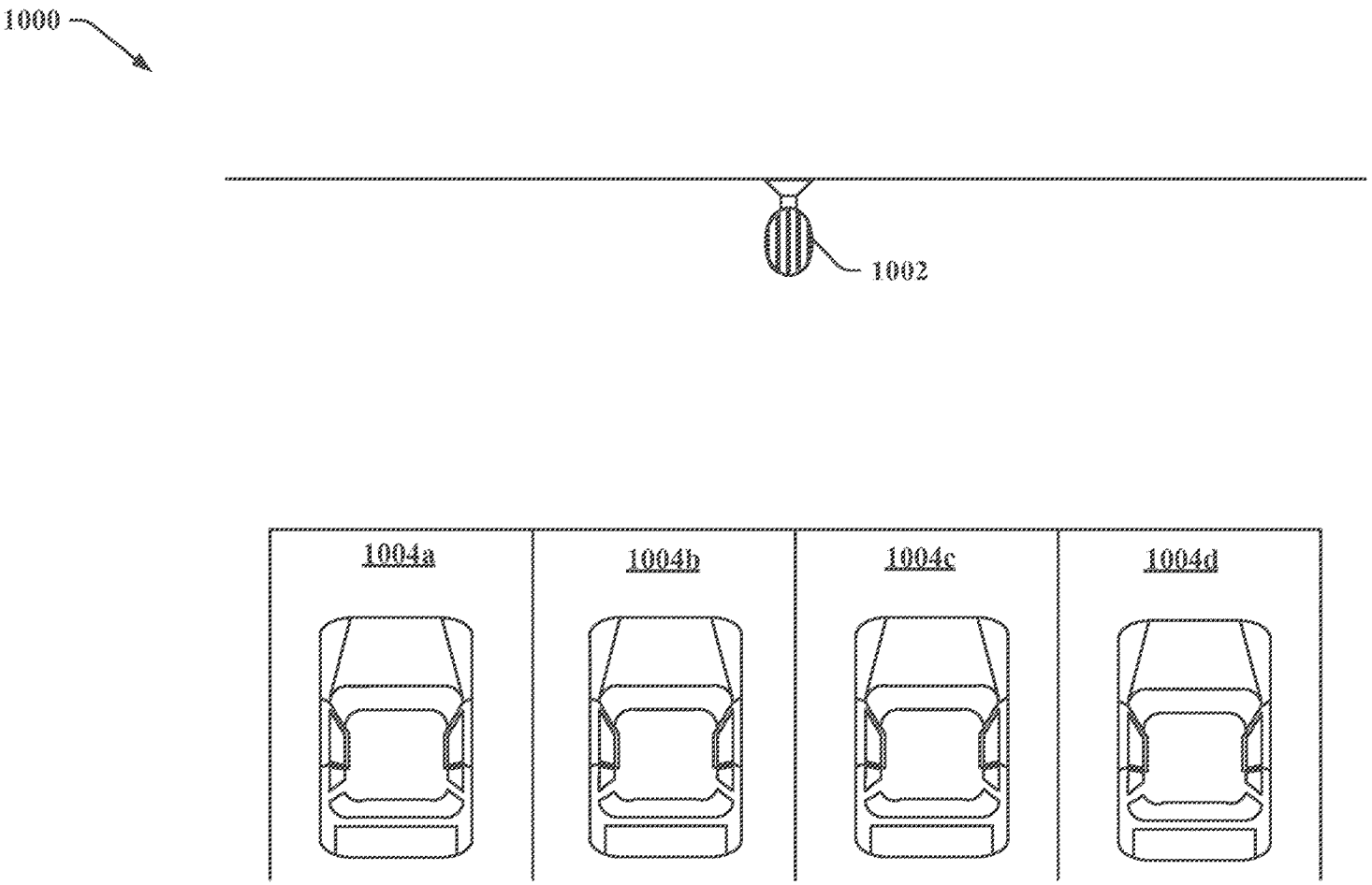
FIG. 10A illustrates a block diagram of an example, non-limiting parking structure environment in accordance with one or more embodiments described herein.

FIG. 10A illustrates a block diagram of an example, non-limiting parking structure environment 1000 in which parking space light 1002 is installed in accordance with one or more embodiments described herein. It is to be appreciated that parking space light 1002 can be a parking space light 502 or 520. In this example, indication component 606 of parking space light 1002 has determined that parking spaces 1004*a*, 1004*b*, 1004*c*, and 1004*d* of its defined region are all occupied with vehicles. Indication component 606 can produce a first light output (e.g. as indicated in the figure by the vertical lines) from parking space light 1002 indicative of all of the spaces in the defined region are occupied.

Figure 10B:
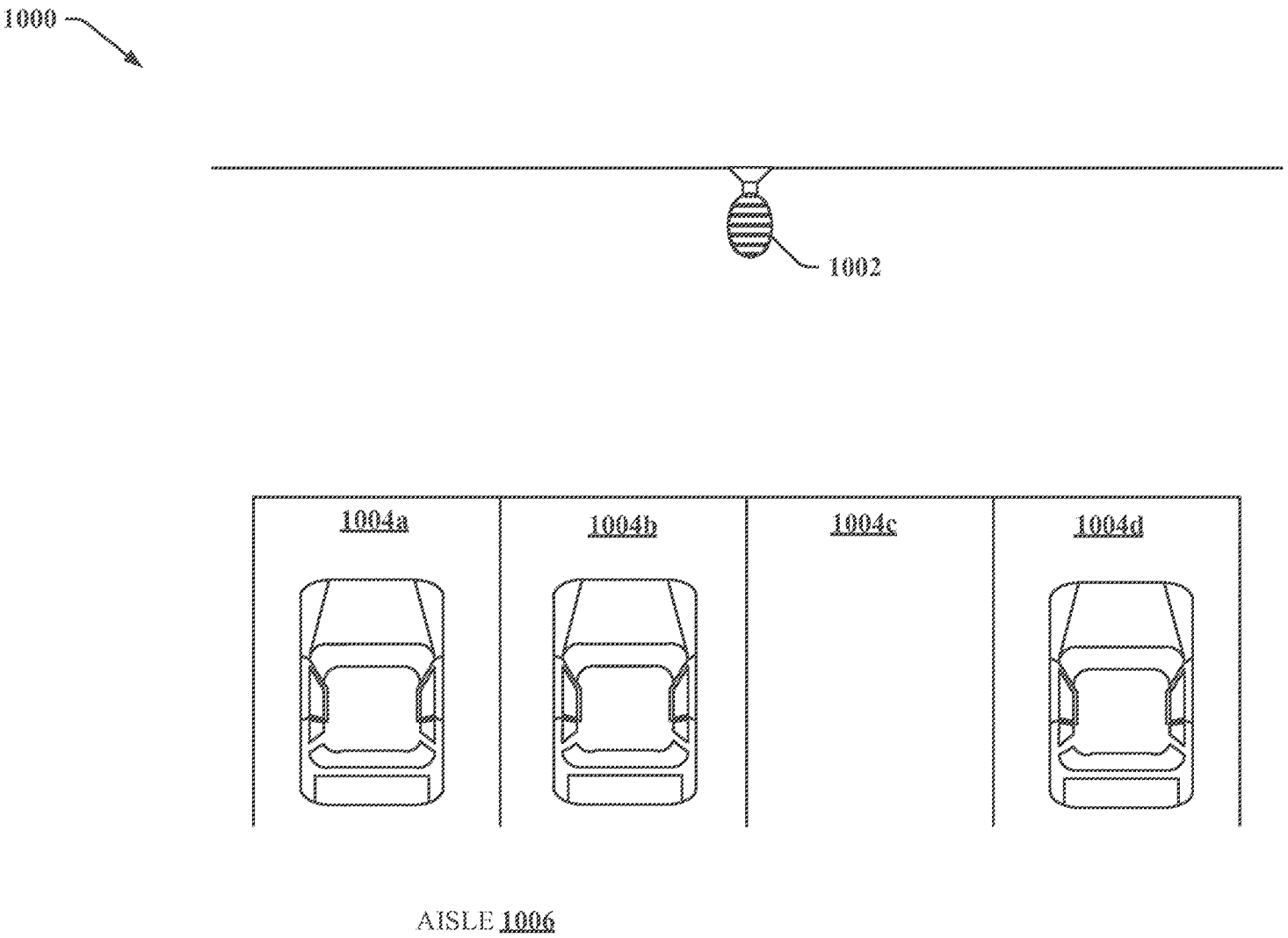
FIG. 10B illustrates a block diagram of an example, non-limiting parking structure environment in accordance with one or more embodiments described herein.

FIG. 10B illustrates a block diagram of an example, non-limiting parking structure environment 1000 from FIG. 10A in which indication component 606 of parking space light 1002 has determined that parking space 1004*c* of its defined region is not occupied. Indication component 606 can produce a second light output (e.g. as indicated in the figure by the horizontal lines) from parking space light 1002 indicative of the unoccupied parking space in the defined region.

Figure 10C:
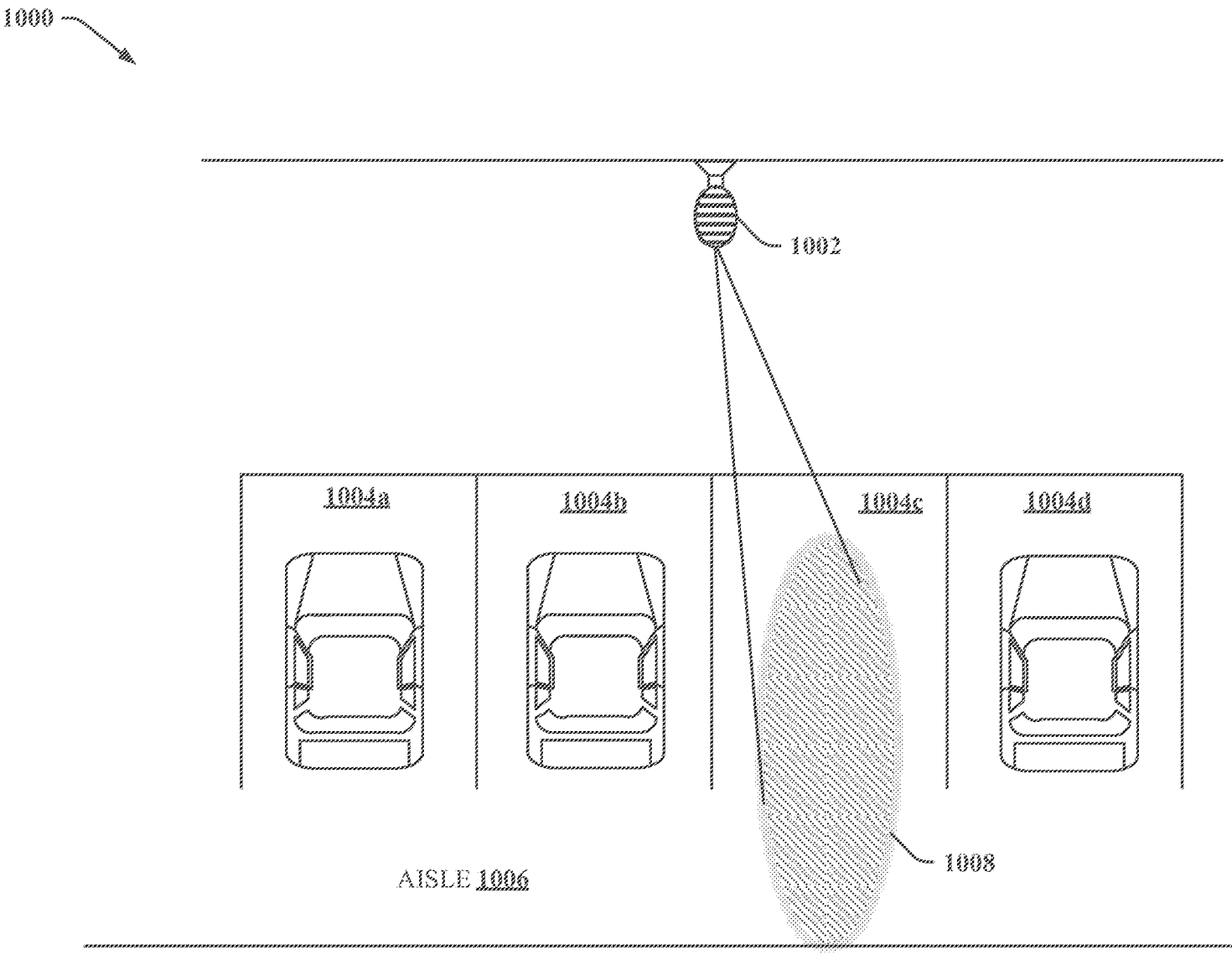
FIG. 10C illustrates a block diagram of an example, non-limiting parking structure environment in accordance with one or more embodiments described herein.

FIG. 10C illustrates a block diagram of an example, non-limiting parking structure environment 1000 from FIG. 10B in which indication component 606 of parking space light 1002 has determined that parking spaces 1004*c* of its defined region is not occupied. Indication component 606 can produce the second light output, as well as, secondary indication by parking space light 1002 that produces a directional light beam 1008 that illuminates parking space 1004*c* more intensely than parking spaces 1004*a*, 1004*b*, and 1004*d* that are occupied. Furthermore, the directional light beam 1008 can extend into aisle 1006 to make the unoccupied spot more visible to a driver looking for a parking space. It is to be appreciated that indication component 606 can employ any combination of indications to bring attention to one or more unoccupied spaces.

Indication component 606 can also communicate information about occupied statuses of parking spaces to one or more devices 518. For example, indication component 606 can communicate parking space data structure to a device 518 that determines a quantity of unoccupied parking spaces in the area of the parking structure and presents the quantity on a display device, such as at an entrance of a parking structure. In another example, indication component 606 of a master parking space light 502 can communicate a quantity of unoccupied parking spaces in an area to a device 518 for presentation of the quantity on the display device. In a further example, indication component 606 of a master parking space light 502 can communicate instructions to display device that control display device to present the quantity of unoccupied parking spaces in the area on the display device. In a further example, indication component 606 of a master parking space light 502 can project a textual display on a surface (e.g. wall, ceiling, floor, column, or any other suitable surface) of the parking structure that indicates the quantity of unoccupied parking spaces in the area. In another example, indication component 606 of a master parking space light 502 can send an electronic message sent to a device 518 (e.g. mobile phone, vehicle navigation system, vehicle display screen, etc.) associated with vehicle moving in or near the parking structure that causes the device 518 to display the quantity of unoccupied parking spaces in the area.

Figure 7B:
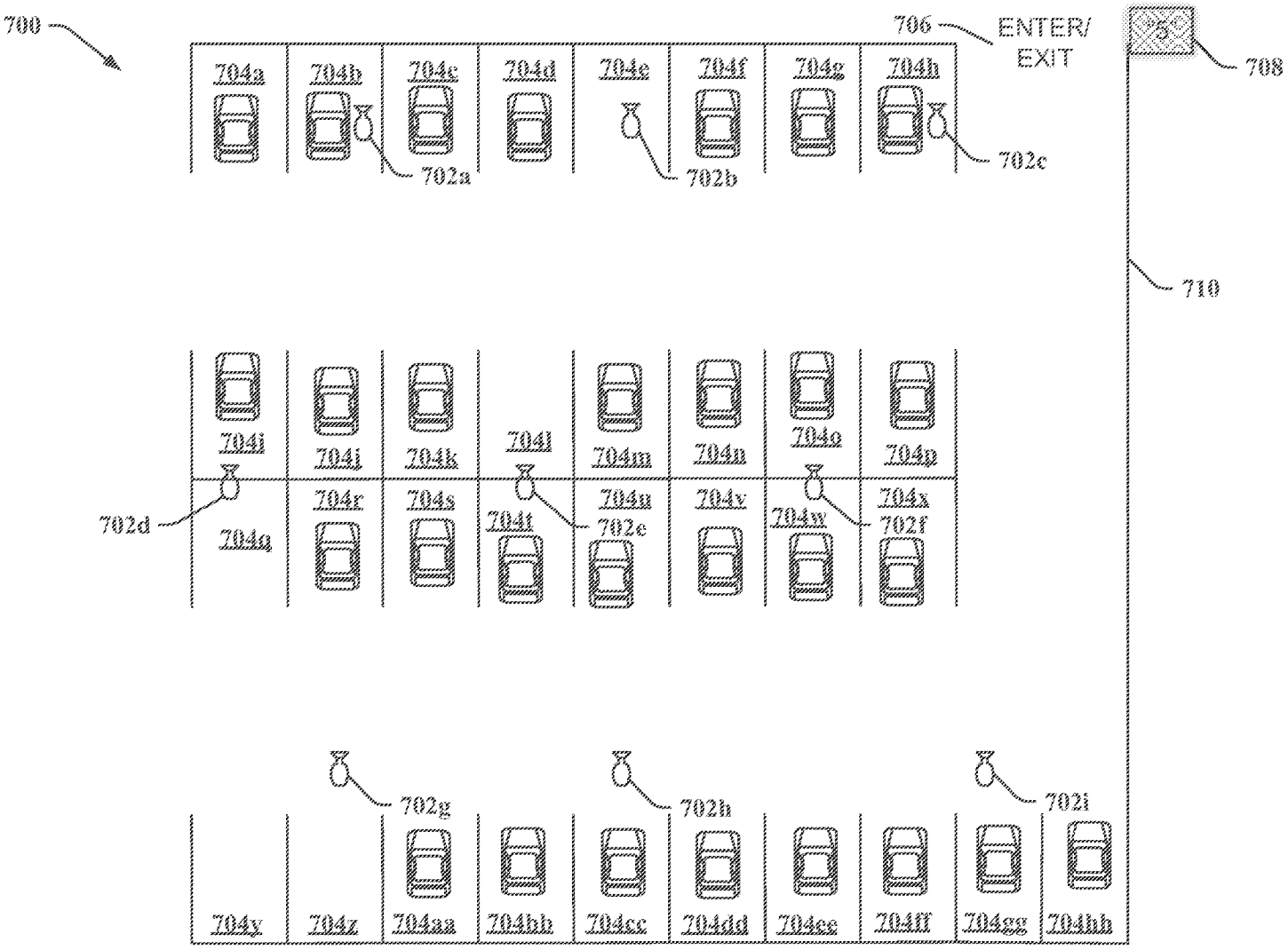
FIG. 7B illustrate a block diagram of an example, non-limiting parking structure environment in accordance with one or more embodiments described herein.

FIG. 7B illustrates a block diagram of an example, non-limiting parking structure environment 700 from FIG. 7A in which indication component(s) 606 from one or more of parking space lights 702*a*, 702*b*, 702*c*, 702*d*, 702*e*, 702*e*, 702*f*, 702*g*, 702*h*, and 702*i* communicate information about occupied statuses of parking spaces in parking structure environment 700 to device 708 near entrance 706. Device 708 can display "5" as an indication of the quantity of unoccupied parking spaces in parking structure environment 700, corresponding to unoccupied parking spaces 704*e*, 7041, 704*q*, 704*y*, and 704*z*.

Figure 7C:
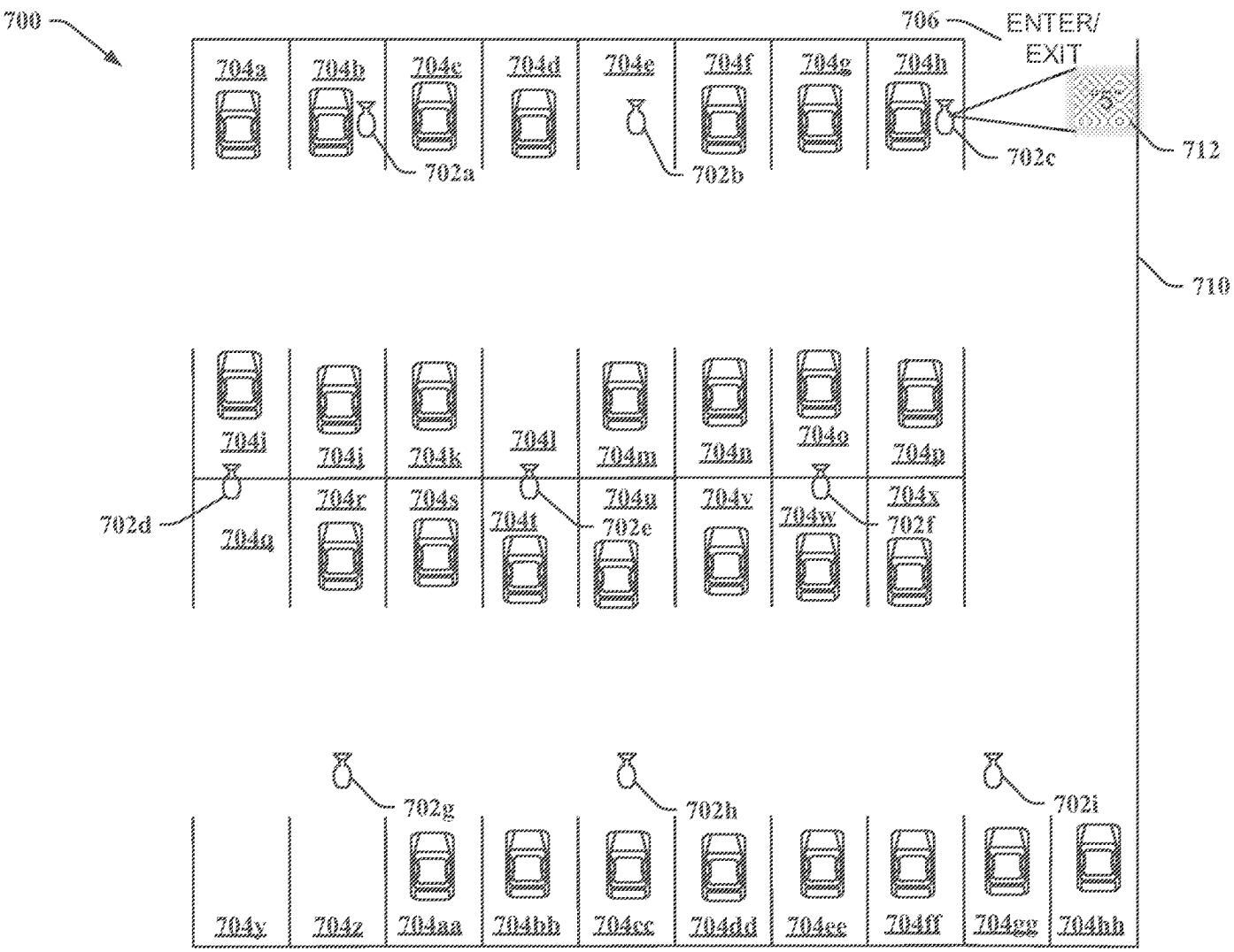
FIG. 7C illustrate a block diagram of an example, non-limiting parking structure environment in accordance with one or more embodiments described herein.

FIG. 7C illustrates a block diagram of an example, non-limiting parking structure environment 700 from FIG. 7A in which indication component 606 from master parking space light 702*c* can emit a light output 712 that projects a display of "5" on wall 710 near entrance 706 as an indication of the quantity of unoccupied parking spaces in parking structure environment 700, corresponding to unoccupied parking spaces 704*e*, 7041, 704*q*, 704*y*, and 704*z*.

Referring back to FIG. 5, parking space light 502 can implement a variety of functionality in various embodiments. For example, parking space light 502 can determine its own operational state (e.g. fault, nearing end of life, etc.) and re-order a replacement parking space light 502 or schedule service based on its operational state. In another example, parking space light 502 can employ its communication devices and/or tools to control other devices 518 in the parking structure.

A set of parking space lights 502 in a parking structure can capture a set of images of the interior/exterior of the parking structure and construct (e.g. stitch together images) a detailed three-dimensional view of the interior/exterior of the parking structure that can be navigated in a viewer. Parking space light 502 has artificial intelligence capabilities and can communicate with other devices 518 to determine actions to perform to enhance operations of the other devices. For example, the parking space light 502 can communicate with devices in its area to identify devices 518 in the parking structure. Parking space light 502 can act as a master and/or slave for these devices 518 to enhance their functionality. A set of parking space lights 502 can operate in a coordinated manner to enhance operations of the other devices 518.

While FIGS. 5 and 6 depict separate components in parking space light 502, it is to be appreciated that two or more components can be implemented in a common component. Further, it is to be appreciated that the design of the parking space light 502 can include other component selections, component placements, etc., to facilitate determining characteristics of the parking structure environment in which the parking space light 502 is installed, determining capabilities of parking space light 502, performing a self-configuration of parking space light 502, and determining and executing suitable actions for parking space light 502 to implement the capability of providing indications of quantity of unoccupied parking spaces and where those unoccupied parking spaces are located in a parking structure in accordance with one or more embodiments described herein. Moreover, the aforementioned systems and/or devices have been described with respect to interaction between several components. It should be appreciated that such systems and components can include those components or sub-components specified therein, some of the specified components or sub-components, and/or additional components. Sub-components could also be implemented as components communicatively coupled to other components rather than included within parent components. Further yet, one or more components and/or sub-components can be combined into a single component providing aggregate functionality. The components can also interact with one or more other components not specifically described herein for the sake of brevity, but known by those of skill in the art.

Further, some of the processes performed may be performed by specialized computers for carrying out defined tasks related to determining characteristics of the environment in which the parking space light 502 is installed, determining capabilities of parking space light 502, performing a self-configuration of parking space light 502 according to the determined one or more objectives, and determining and executing suitable actions for parking space light 502 to implement the capability of providing indications of quantity of unoccupied parking spaces and where those unoccupied parking spaces are located in a parking structure. The subject computer processing systems, methods apparatuses and/or computer program products can be employed to solve new problems that arise through advancements in technology, computer networks, the Internet and the like. The subject computer processing systems, methods apparatuses and/or computer program products can provide technical improvements to systems for determining characteristics of the environment in which the parking space light 502 is installed, determining capabilities of parking space light 502, performing a self-configuration of parking space light 502 according to the determined one or more objectives, and determining and executing suitable actions for parking space light 502 to implement the capability of providing indications of quantity of unoccupied parking spaces and where those unoccupied parking spaces are located in a parking structure by improving processing efficiency among processing components in these systems, reducing delay in processing performed by the processing components, reducing memory requirements, and/or improving the accuracy in which the processing systems are determining characteristics of the environment in which the parking space light 502 is installed, determining capabilities of parking space light 502, performing a self-configuration of parking space light 502 according to the determined one or more objectives, and determining and executing suitable actions for parking space light 502 to implement the capability of providing indications of quantity of unoccupied parking spaces and where those unoccupied parking spaces are located in a parking structure.

It is to be appreciated that the any criteria or thresholds disclosed herein can be pre-defined, operator specified, and/or dynamically determined, for example, based on learning algorithms.

The embodiments of devices described herein can employ artificial intelligence (AI) to facilitate automating one or more features described herein. The components can employ various AI-based schemes for carrying out various embodiments/examples disclosed herein. In order to provide for or aid in the numerous determinations (e.g., determine, ascertain, infer, calculate, predict, prognose, estimate, derive, forecast, detect, compute) described herein, components described herein can examine the entirety or a subset of the data to which it is granted access and can provide for reasoning about or determine states of the system, environment, etc. from a set of observations as captured via events and/or data. Determinations can be employed to identify a specific context or action, or can generate a probability distribution over states, for example. The determinations can be probabilistic—that is, the computation of a probability distribution over states of interest based on a consideration of data and events. Determinations can also refer to techniques employed for composing higher-level events from a set of events and/or data.

Such determinations can result in the construction of new events or actions from a set of observed events and/or stored event data, whether or not the events are correlated in close temporal proximity, and whether the events and data come from one or several event and data sources. Components disclosed herein can employ various classification (explicitly trained (e.g., via training data) as well as implicitly trained (e.g., via observing behavior, preferences, historical information, receiving extrinsic information, etc.)) schemes and/or systems (e.g., support vector machines, neural networks, expert systems, Bayesian belief networks, fuzzy logic, data fusion engines, etc.) in connection with performing automatic and/or determined action in connection with the claimed subject matter. Thus, classification schemes and/or systems can be used to automatically learn and perform a number of functions, actions, and/or determination.

A classifier can map an input attribute vector, z=(z1, z2, z3, z4, zn), to a confidence that the input belongs to a class, as by f(z)=confidence(class). Such classification can employ a probabilistic and/or statistical-based analysis (e.g., factoring into the analysis utilities and costs) to determinate an action to be automatically performed. A support vector machine (SVM) is an example of a classifier that can be employed. The SVM operates by finding a hyper-surface in the space of possible inputs, where the hyper-surface attempts to split the triggering criteria from the non-triggering events. Intuitively, this makes the classification correct for testing data that is near, but not identical to training data. Other directed and undirected model classification approaches include, e.g., naïve Bayes, Bayesian networks, decision trees, neural networks, fuzzy logic models, and/or probabilistic classification models providing different patterns of independence can be employed. Classification as used herein also is inclusive of statistical regression that is utilized to develop models of priority.

Figure 11:
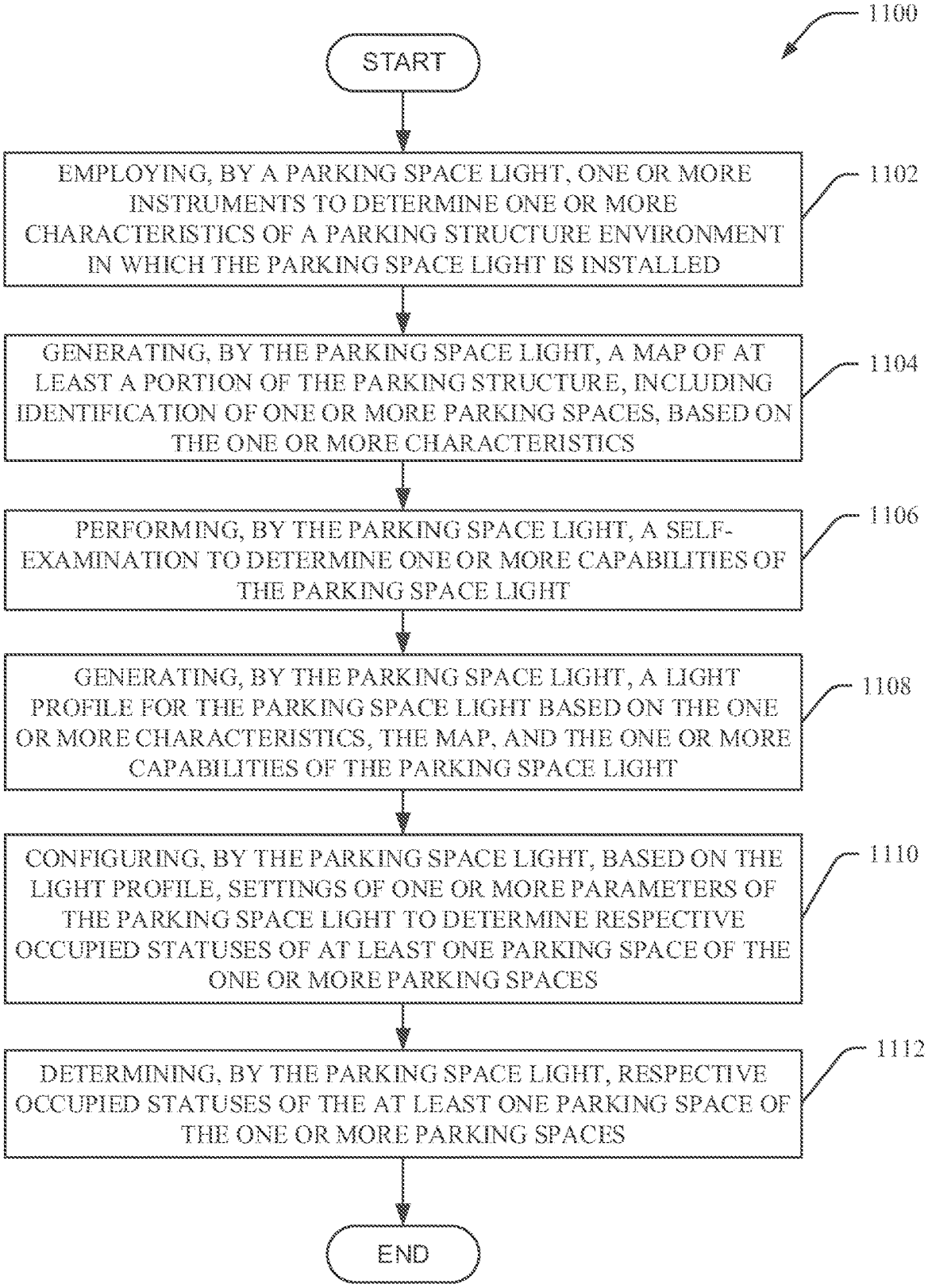
FIG. 11 illustrates a flow diagram of an example, non-limiting computer-implemented method that facilitates operation of a parking space light in accordance with one or more embodiments described herein.

FIG. 11 illustrates a flow diagram of an example, non-limiting computer-implemented method 1100 that facilitates operation of a parking space light 502 in accordance with one or more embodiments described herein. Repetitive description of like elements employed in other embodiments described herein is omitted for sake of brevity.

At 1102, method 1100 comprises employing, by a parking space light, one or more instruments to determine one or more characteristics of a parking structure environment in which the parking space light is installed (e.g., via a mapping component 602, parking structure component 504, and/or parking space light 502). At 1104, method 1100 comprises generating, by the parking space light, a map of at least a portion of the parking structure, including identification of one or more parking spaces, based on the one or more characteristics (e.g., via a mapping component 602, parking structure component 504, and/or parking space light 502). At 1106, method 1100 comprises performing, by the parking space light, a self-examination to determine one or more capabilities of the parking space light (e.g., via a mapping component 602, parking structure component 504, and/or parking space light 502). At 1108, method 1100 comprises generating, by the parking space light, a light profile for the parking space light based on the one or more characteristics, the map, and the one or more capabilities of the parking space light (e.g., via a mapping component 602, parking structure component 504, and/or parking space light 502). At 1110, method 1100 comprises configuring, by the parking space light, based on the light profile, settings of one or more parameters of the parking space light to determine respective occupied statuses of at least one parking space of the one or more parking spaces (e.g., via a parking space monitoring component 604, parking structure component 504, and/or parking space light 502). At 1112, method 1100 comprises determining, by the parking space light, respective occupied statuses of the at least one parking space of the one or more parking spaces (e.g., via a parking space monitoring component 604, parking structure component 504, and/or parking space light 502).

Figure 12:
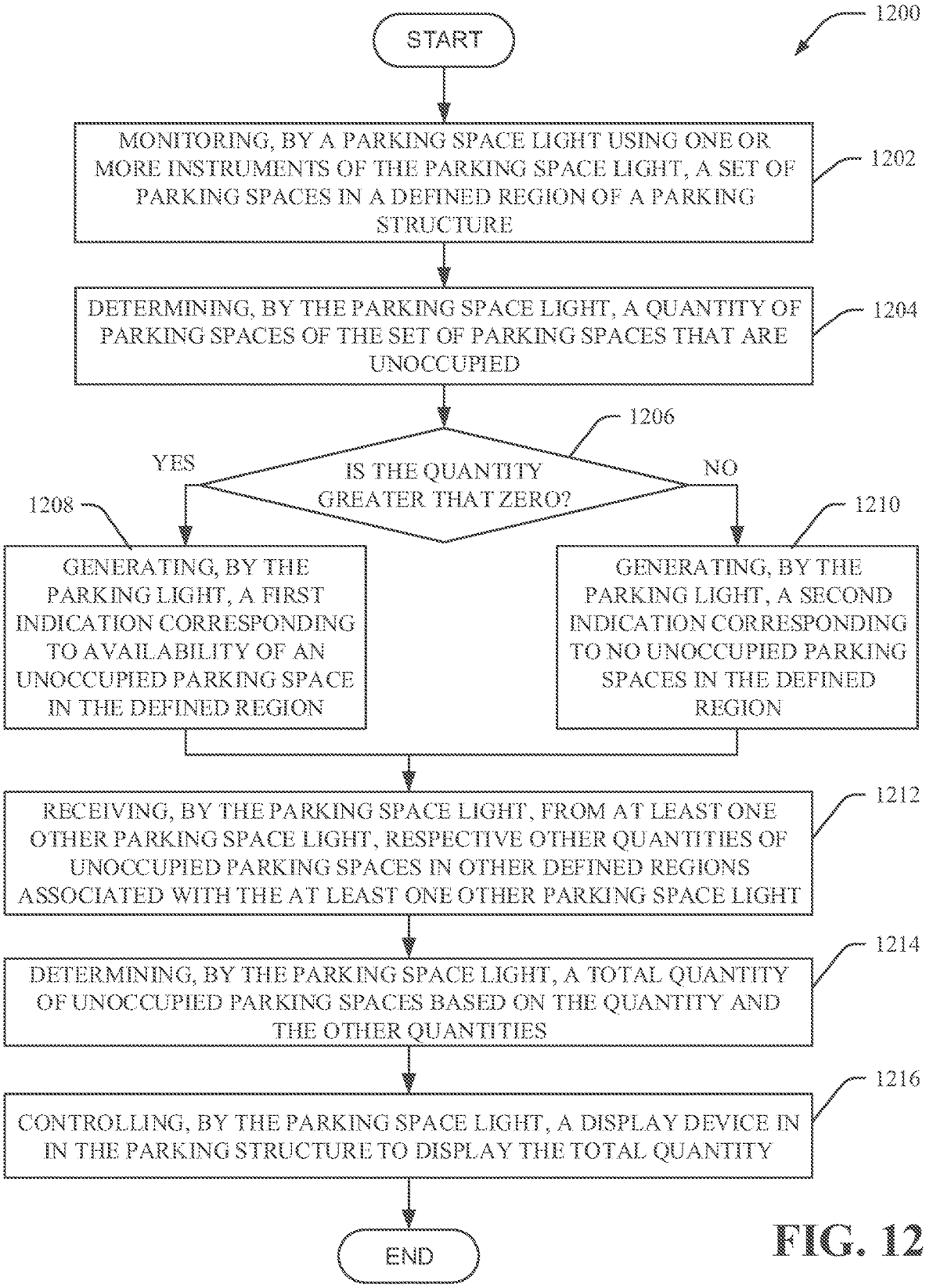
FIG. 12 illustrates a flow diagram of an example, non-limiting computer-implemented method that facilitates operation of a parking space light in accordance with one or more embodiments described herein.

FIG. 12 illustrates a flow diagram of an example, non-limiting computer-implemented method 1200 that facilitates operation of a parking space light 502 in accordance with one or more embodiments described herein. Repetitive description of like elements employed in other embodiments described herein is omitted for sake of brevity.

At 1202, method 1200 comprises monitoring, by a parking space light using one or more instruments of the parking space light, a set of parking spaces in a defined region of a parking structure (e.g., via a parking space monitoring component 604, parking structure component 504, and/or parking space light 502). At 1204, method 1200 comprises determining, by the parking space light, a quantity of parking spaces of the set of parking spaces that are unoccupied (e.g., via a parking space monitoring component 604, an indication component 606, parking structure component 504, and/or parking space light 502). At 1206, method 1200 comprises determining, by the parking space light, if the quantity is greater than zero (e.g., via an indication component 606, parking structure component 504, and/or parking space light 502). If the determination at 1206 is "YES", meaning that the quantity is greater than zero, the method proceeds to 1208. If the determination at 1206 is "NO", meaning that the quantity is not greater than zero, the method proceeds to 1210. At 1208, method 1200 comprises generating, by the parking light, a first indication corresponding to availability of an unoccupied parking space in the defined region (e.g., via an indication component 606, parking structure component 504, and/or parking space light 502). At 1210, method 1200 comprises generating, by the parking light, a second indication corresponding to no unoccupied parking spaces in the defined region (e.g., via an indication component 606, parking structure component 504, and/or parking space light 502). At 1212, method 1200 comprises receiving, by the parking space light, from at least one other parking space light, respective other quantities of unoccupied parking spaces in other defined regions associated with the at least one other parking space light (e.g., via an indication component 606, parking structure component 504, and/or parking space light 502). At 1214, method 1200 comprises determining, by the parking space light, a total quantity of unoccupied parking spaces based on the quantity and the other quantities (e.g., via an indication component 606, parking structure component 504, and/or parking space light 502). At 1216, method 1200 comprises controlling, by the parking space light, a display device in the parking structure to display the total quantity (e.g., via an indication component 606, parking structure component 504, and/or parking space light 502).

For simplicity of explanation, the computer-implemented methodologies are depicted and described as a series of acts. It is to be understood and appreciated that the subject innovation is not limited by the acts illustrated and/or by the order of acts, for example acts can occur in various orders and/or concurrently, and with other acts not presented and described herein. Furthermore, not all illustrated acts can be required to implement the computer-implemented methodologies in accordance with the disclosed subject matter. In addition, those skilled in the art will understand and appreciate that the computer-implemented methodologies could alternatively be represented as a series of interrelated states via a state diagram or events. Additionally, it should be further appreciated that the computer-implemented methodologies disclosed hereinafter and throughout this specification are capable of being stored on an article of manufacture to facilitate transporting and transferring such computer-implemented methodologies to computers. The term article of manufacture, as used herein, is intended to encompass a computer program accessible from any computer-readable device or storage media.

Figure 13:
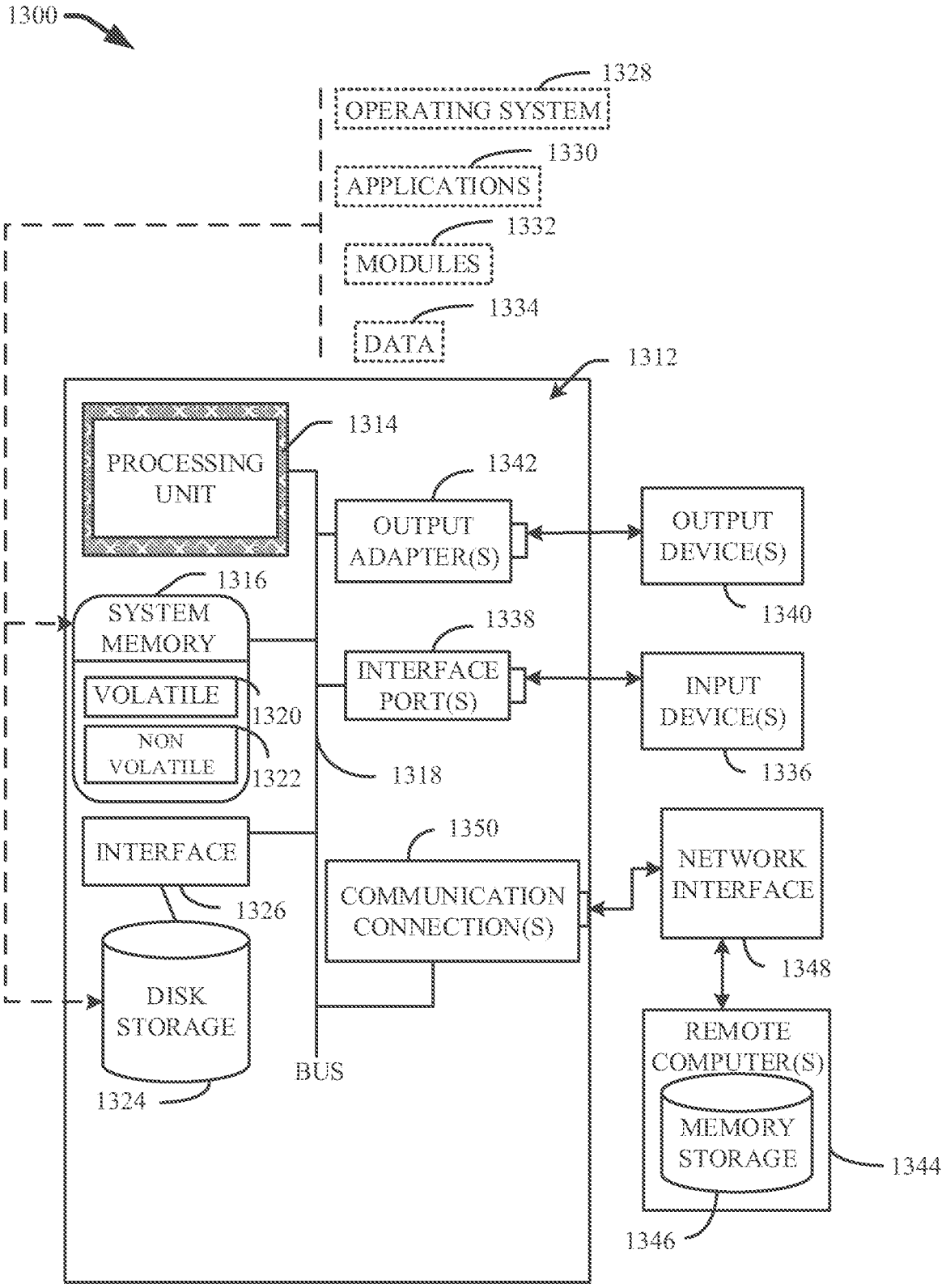
FIG. 13 illustrates a block diagram of an example, non-limiting operating environment in which one or more embodiments described herein can be facilitated.

In order to provide a context for the various aspects of the disclosed subject matter, FIG. 13 as well as the following discussion are intended to provide a general description of a suitable environment in which the various aspects of the disclosed subject matter can be implemented. FIG. 13 illustrates a block diagram of an example, non-limiting operating environment in which one or more embodiments described herein can be facilitated. Repetitive description of like elements employed in other embodiments described herein is omitted for sake of brevity.

With reference to FIG. 13, a suitable operating environment 1300 for implementing various aspects of this disclosure can also include a computer 1312. The computer 1312 can also include a processing unit 1314, a system memory 1316, and a system bus 1318. The system bus 1318 couples system components including, but not limited to, the system memory 1316 to the processing unit 1314. The processing unit 1314 can be any of various available processors. Dual microprocessors and other multiprocessor architectures also can be employed as the processing unit 1314. The system bus 1318 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Firewire (IEEE 1394), and Small Computer Systems Interface (SCSI). The system memory 1316 can also include volatile memory 1320 and nonvolatile memory 1322. The basic input/output system (BIOS), containing the basic routines to transfer information between elements within the computer 1312, such as during start-up, is stored in nonvolatile memory 1322. By way of illustration, and not limitation, nonvolatile memory 1322 can include read only memory (ROM), programmable ROM (PROM), electrically programmable ROM (EPROM), electrically erasable programmable ROM (EEPROM), flash memory, or nonvolatile random access memory (RAM) (e.g., ferroelectric RAM (FeRAM). Volatile memory 1320 can also include random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM.

Computer 1312 can also include removable/non-removable, volatile/nonvolatile computer storage media. FIG. 13 illustrates, for example, a disk storage 1324. Disk storage 1324 can also include, but is not limited to, devices like a magnetic disk drive, floppy disk drive, tape drive, Jaz drive, Zip drive, LS-100 drive, flash memory card, or memory stick. The disk storage 1324 also can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage 1324 to the system bus 1318, a removable or non-removable interface is typically used, such as interface 1326. FIG. 13 also depicts software that acts as an intermediary between users and the basic computer resources described in the suitable operating environment 1300. Such software can also include, for example, an operating system 1328. Operating system 1328, which can be stored on disk storage 1324, acts to control and allocate resources of the computer 1312. System applications 1330 take advantage of the management of resources by operating system 1328 through program modules 1332 and program data 1334, e.g., stored either in system memory 1316 or on disk storage 1324. It is to be appreciated that this disclosure can be implemented with various operating systems or combinations of operating systems. A user enters commands or information into the computer 1312 through input device(s) 1336. Input devices 1336 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1314 through the system bus 1318 via interface port(s) 1338. Interface port(s) 1338 include, for example, a serial port, a parallel port, a game port, and a universal serial bus (USB). Output device(s) 1340 use some of the same type of ports as input device(s) 1336. Thus, for example, a USB port can be used to provide input to computer 1312, and to output information from computer 1312 to an output device 1340. Output adapter 1342 is provided to illustrate that there are some output devices 1340 like monitors, speakers, and printers, among other output devices 1340, which require special adapters. The output adapters 1342 include, by way of illustration and not limitation, video and sound cards that provide a means of connection between the output device 1340 and the system bus 1318. It should be noted that other devices and/or systems of devices provide both input and output capabilities such as remote computer(s) 1344.

Computer 1312 can operate in a networked environment using logical connections to one or more remote computers, such as remote computer(s) 1344. The remote computer(s) 1344 can be a computer, a server, a router, a network PC, a workstation, a microprocessor based appliance, a peer device or other common network node and the like, and typically can also include many or all of the elements described relative to computer 1312. For purposes of brevity, only a memory storage device 1346 is illustrated with remote computer(s) 1344. Remote computer(s) 1344 is logically connected to computer 1312 through a network interface 1348 and then physically connected via communication connection 1350. Network interface 1348 encompasses wire and/or wireless communication networks such as local-area networks (LAN), wide-area networks (WAN), cellular networks, etc. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL). Communication connection(s) 1350 refers to the hardware/software employed to connect the network interface 1348 to the system bus 1318. While communication connection 1350 is shown for illustrative clarity inside computer 1312, it can also be external to computer 1312. The hardware/software for connection to the network interface 1348 can also include, for exemplary purposes only, internal and external technologies such as, modems including regular telephone grade modems, cable modems and DSL modems, ISDN adapters, and Ethernet cards.

Embodiments of the present invention may be a system, a method, an apparatus and/or a computer program product at any possible technical detail level of integration. The computer program product can include a computer readable storage medium (or media) having computer readable program instructions thereon for causing a processor to carry out aspects of the present invention. The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium can also include the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network can comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of various aspects of the present invention can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer readable program instructions by utilizing state information of the computer readable program instructions to customize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions. These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions can also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks. The computer readable program instructions can also be loaded onto a computer, other programmable data processing apparatus, or other device to cause a series of operational acts to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams can represent a module, segment, or portion of instructions, which comprises one or more executable instructions for implementing the specified logical function(s). In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the subject matter has been described above in the general context of computer-executable instructions of a computer program product that runs on a computer and/or computers, those skilled in the art will recognize that this disclosure also can or can be implemented in combination with other program modules. Generally, program modules include routines, programs, components, data structures, etc. that perform particular tasks and/or implement particular abstract data types. Moreover, those skilled in the art will appreciate that the inventive computer-implemented methods can be practiced with other computer system configurations, including single-processor or multiprocessor computer systems, mini-computing devices, mainframe computers, as well as computers, hand-held computing devices (e.g., PDA, phone), microprocessor-based or programmable consumer or industrial electronics, and the like. The illustrated aspects can also be practiced in distributed computing environments where tasks are performed by remote processing devices that are linked through a communications network. However, some, if not all aspects of this disclosure can be practiced on stand-alone computers. In a distributed computing environment, program modules can be located in both local and remote memory storage devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," "data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim. The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A parking space light bulb configured for installation in a light fixture, the parking space light bulb comprising:
- one or more instruments;
- a memory that stores computer executable components; and
- a processor that executes the computer executable components stored in the memory, wherein the computer executable components comprise:
  - a parking space monitoring component that:
    - monitors a set of parking spaces in a defined region of a parking structure in which the parking space light bulb is installed, and
    - determines respective occupied statuses of parking spaces of the set of parking spaces, wherein the respective occupied statuses indicate whether the parking spaces are occupied or unoccupied,
  - wherein the parking space monitoring component receives information sensed by another parking space light bulb of a portion of the parking space that is partially obstructed from view of the one or more instruments, and determines an occupied status of the parking space based at least on the information.

2. The parking space light bulb of claim 1, further comprising:
- a mapping component that employs at least one instrument of the one or more instruments to identify the set of parking spaces in the defined region of the parking structure in which the parking space light bulb is installed.

3. The parking space light bulb of claim 2, wherein the mapping component further:
- employs the at least one instrument to determine one or more characteristics of the parking structure;
- generates a map of at least a portion of the parking structure based on the one or more characteristics; and
- identifies the set of parking spaces in the defined region based on the map.

4. The parking space light bulb of claim 2, wherein the mapping component further performs a self-examination of the parking space light bulb to determine one or more capabilities of the parking space light bulb.

5. The parking space light bulb of claim 2, wherein the mapping component further generates a light profile for the parking space light bulb based on at least one of a map of at least a portion of the parking structure, one or more characteristics of the parking structure, or one or more capabilities of the parking space light bulb.

6. The parking space light bulb of claim 5, wherein the parking space monitoring component further configures, based on the light profile, settings of one or more parameters of the parking space light bulb to determine the respective occupied statuses of the parking spaces.

7. The parking space light bulb of claim 1, further comprising an indication component that determines a quantity of the parking spaces of the set of parking spaces that are unoccupied based on the respective occupied statuses, and presents a notification indicating the quantity of the parking spaces of the set of parking spaces that are unoccupied.

8. A parking space light comprising:

a parking space light fixture;

a parking space light bulb configured for installation in the parking space light fixture;

one or more instruments located in at least one of the parking space light bulb or the parking space light fixture;

a memory that stores computer executable components; and a processor that executes the computer executable components stored in the memory, wherein the computer executable components comprise:

a mapping component that employs at least one instrument of the one or more instruments to identify a set of parking spaces in a defined region of a parking structure in which the parking space light is installed;

a parking space monitoring component that:

monitors a set of parking spaces in a defined region of a parking structure in which the parking space light bulb is installed; and determines respective occupied statuses of parking spaces of the set of parking spaces, wherein the respective occupied statuses indicate whether the parking spaces are occupied or unoccupied, wherein the parking space monitoring component receives information sensed by another parking space light bulb of a portion of the parking space of the set of parking spaces that is partially obstructed from view of the at least one instrument of the parking space light bulb, and determines an occupied status of the parking space based at least on the information.

9. The parking space light of claim 8, wherein the mapping component further:

employs the at least one instrument to determine one or more characteristics of the parking structure;

generates a map of at least a portion of the parking structure based on the one or more characteristics; and identifies the set of parking spaces in the defined region based on the map.

10. The parking space light of claim 8, wherein the mapping component further performs a self-examination of the parking space light bulb to determine one or more capabilities of the parking space light bulb.

11. The parking space light of claim 8, wherein the mapping component further generates a light profile for the parking space light bulb based on at least one of a map of at least a portion of the parking structure, one or more characteristics of the parking structure, or one or more capabilities of the parking space light bulb.

12. The parking space light of claim 11, wherein the parking space monitoring component further configures, based on the light profile, settings of one or more parameters of the parking space light bulb to determine the respective occupied statuses of the parking spaces.

13. The parking space light bulb of claim 8, further comprising an indication component that determines a quantity of the parking spaces of the set of parking spaces that are unoccupied based on the respective occupied statuses, and presents a notification indicating the quantity of the parking spaces of the set of parking spaces that are unoccupied.

14. A method comprising:

monitoring, by a parking space light bulb via one or more instruments of the parking space light bulb, a set of parking spaces in a defined region of a parking structure in which the parking space light bulb is installed; and determining, by the parking space light bulb, respective occupied statuses of parking spaces of the set of parking spaces, wherein the respective occupied statuses indicate whether the parking spaces are occupied or unoccupied, and wherein the determining comprises receiving information sensed by another parking space light bulb of a portion of the parking space of the set of parking spaces that is partially obstructed from view of the at least one instrument of the parking space light bulb, and determining an occupied status of the parking space based at least on the information.

15. The method of claim 14, further comprising:

identifying, by the parking space light bulb via the one or more instruments, a set of parking spaces in a defined region of a parking structure in which the parking space light bulb is installed.

16. The method of claim 15, further comprising:

employing, by the parking space light bulb, the at least one instrument to determine one or more characteristics of the parking structure;

generating, by the parking space light bulb, a map of at least a portion of the parking structure based on the one or more characteristics; and identifying, by the parking space light bulb, the set of parking spaces in the defined region based on the map.

17. The method of claim 15, further comprising:

performing, by the parking space light bulb, a self-examination of the parking space light bulb to determine one or more capabilities of the parking space light bulb; and generating, by the parking space light bulb, a light profile for the parking space light bulb based on at least one of the map of at least a portion of the parking structure, the one or more characteristics of the parking structure, or the one or more capabilities of the parking space light bulb.

18. The method of claim 17, further comprising configuring, by the parking space light bulb based on the light profile, settings of one or more parameters of the parking space light bulb to determine the respective occupied statuses of the parking spaces.

19. The method of claim 14, further comprising:

determines, by the parking space light bulb, a quantity of the parking spaces of the set of parking spaces that are unoccupied based on the respective occupied statuses; and presenting, by the parking space light bulb, a notification indicating the quantity of the parking spaces of the set of parking spaces that are unoccupied.

* * * * *